US009547250B2

(12) United States Patent
Kikuchi et al.

(10) Patent No.: US 9,547,250 B2
(45) Date of Patent: Jan. 17, 2017

(54) ELECTROCONDUCTIVE MEMBER FOR ELECTROPHOTOGRAPHY, PROCESS CARTRIDGE AND ELECTROPHOTOGRAPHIC APPARATUS

(71) Applicant: CANON KABUSHIKI KAISHA, Tokyo (JP)

(72) Inventors: Yuichi Kikuchi, Susono (JP); Kazuhiro Yamauchi, Suntou-gun (JP); Norifumi Muranaka, Yokohama (JP); Satoru Yamada, Numazu (JP); Tetsuo Hino, Yamato (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 101 days.

(21) Appl. No.: 14/666,234

(22) Filed: Mar. 23, 2015

(65) Prior Publication Data

US 2015/0198904 A1 Jul. 16, 2015

Related U.S. Application Data

(63) Continuation of application No. PCT/JP2014/004937, filed on Sep. 26, 2014.

(30) Foreign Application Priority Data

Sep. 27, 2013 (JP) ..... 2013-202662

(51) Int. Cl.
*G03G 15/02* (2006.01)
*G03G 15/08* (2006.01)
(Continued)

(52) U.S. Cl.
CPC ..... *G03G 15/02* (2013.01); *G03G 15/0233* (2013.01); *G03G 15/0818* (2013.01);
(Continued)

(58) Field of Classification Search
CPC .... G03G 15/0233; G03G 15/02; G03G 15/14; G03G 15/0818; G03G 15/1685; D01D 5/0007; F16C 13/00; D10B 2401/16; Y10T 428/2495
See application file for complete search history.

(56) References Cited

U.S. PATENT DOCUMENTS 5,790,926 A 8/1998 Mizoe et al.
7,374,639 B2 * 5/2008 Ampulski ..... D21F 1/0036 162/116
(Continued)

FOREIGN PATENT DOCUMENTS

JP 9-101650 A 4/1997
JP 2002-268332 A 9/2002
(Continued)

OTHER PUBLICATIONS

International Preliminary Report on Patentability, International Application No. PCT/JP2014/004937, Mailing Date Apr. 7, 2016.

*Primary Examiner* — Jason L Vaughan
(74) *Attorney, Agent, or Firm* — Fitzpatrick, Cella, Harper & Scinto

(57) ABSTRACT

The present invention relates to an electroconductive member including an electroconductive support layer and a surface layer formed on a circumference thereof and having a network structure containing fibers, in which an arithmetic mean value $d^{L/10}$ of top 10% fiber diameters is 0.2 μm or more and 15.0 μm or less, rigid structural body having a height of $1.0\times10^{-2}$ to $1.0\times10^{1}$ times as large as a thickness of the surface layer are present on the outer circumferential portion of the electroconductive support layer, and the surface layer satisfies specific conditions.

13 Claims, 4 Drawing Sheets

(51) Int. Cl.
*G03G 15/16* (2006.01)
*G03G 15/14* (2006.01)

(52) U.S. Cl.
CPC ..... *G03G 15/14* (2013.01); *G03G 15/1685* (2013.01); *Y10T 428/2495* (2015.01)

(56) References Cited

U.S. PATENT DOCUMENTS 7,917,064 B2 * 3/2011 Nagamori ..... G03G 15/0233 399/176
8,257,641 B1 * 9/2012 Qi ..... G03G 15/2057 264/172.15
8,265,525 B2 * 9/2012 Wada ..... G03G 15/0233 399/176
8,422,906 B2 4/2013 Komiyama et al.
8,532,535 B2 * 9/2013 Nose ..... G03G 15/0233 399/176
8,574,713 B2 * 11/2013 Rutledge ..... D01D 5/0038 428/292.1
8,725,043 B2 * 5/2014 Hoshio ..... G03G 15/0233 399/176
9,176,414 B2 * 11/2015 Sato ..... G03G 15/0233
9,234,300 B2 * 1/2016 Law ..... D01D 5/0007
9,274,496 B2 * 3/2016 Miyagawa ..... G03G 21/18
2010/0291182 A1 * 11/2010 Palasis ..... A61K 9/0024 424/426
2010/0297906 A1 * 11/2010 Steckl ..... D01D 5/0084 442/347
2012/0224897 A1 * 9/2012 Qi ..... B82Y 30/00 399/333
2015/0198900 A1 7/2015 Yamada et al.
2015/0198906 A1 7/2015 Yamauchi et al.

FOREIGN PATENT DOCUMENTS

JP 2004-117783 A 4/2004
JP 2008-276026 A 11/2008
JP 2009-300849 A 12/2009
JP 2011-123387 A 6/2011

* cited by examiner

ELECTROCONDUCTIVE MEMBER FOR ELECTROPHOTOGRAPHY, PROCESS CARTRIDGE AND ELECTROPHOTOGRAPHIC APPARATUS

CROSS-REFERENCE TO RELATED APPLICATIONS

This application is a continuation of International Application No. PCT/JP2014/004937, filed Sep. 26, 2014, which claims the benefit of Japanese Patent Application No. 2013-202662, filed Sep. 27, 2013.

BACKGROUND OF THE INVENTION

Field of the Invention

The present invention relates to an electroconductive member for electrophotography, a process cartridge and an electrophotographic apparatus.

Description of the Related Art

In an electrophotographic apparatus, that is, an image forming apparatus employing an electrophotographic method, electroconductive members are used for various purposes, for example, as a charging roller, a developing roller and a transfer roller. It is necessary to control the electrical resistance value of such an electroconductive member used in an electrophotographic apparatus to be $10^3$ to $10^{10}\Omega$, and for this purpose, an electron conducting agent represented by carbon black or an ion conducting agent such as a quaternary ammonium salt compound is incorporated into the electroconductive member.

An electron conducting agent such as carbon black is used as a conducting agent for various electroconductive members because the electrical resistance value is not affected by use environments such as a temperature and a humidity. It is known, however, that if an electroconductive member is provided with conductivity by using an electron conducting agent such as carbon black, there is a possibility that non-uniformity in the electrical resistance value of the conductive member may be caused due to non-uniform dispersion of the electron conducting agent. In particular, it is extremely difficult to prevent a portion or site having a lower electrical resistance value from occurring locally in the conductive member due to aggregation of the electron conducting agent.

On the other hand, in an electroconductive member into which an ion conducting agent is incorporated, the ion conducting agent is dispersed at the molecular size level, and hence, the non-uniformity in the electrical resistance value can be reduced as compared with the case where an electron conducting agent is used. The resultant electroconductive member has, however, a disadvantage that the electrical resistance value is largely varied depending on the temperature and the humidity of the use environment. It is known that there is a possibility that the electrical resistance value becomes higher due to drying of the electroconductive member particularly under a low-temperature and low-humidity environment of a temperature of 15° C. and a relative humidity of 10% (hereinafter sometimes referred to as "under the L/L environment").

Thus, it is difficult to achieve both reduction of the non-uniformity in the electrical resistance value of the electroconductive member due to the non-uniform dispersion of the conducting agent and inhibition of the variation in the electrical resistance value of the electroconductive member due the use environment. In order to improve this issue, in Japanese Patent Application Laid-Open No. H09-101650, a raised electroconductive fiber entangled material is provided on the surface of a charging member for attaining uniformity in the electrical resistance value on the surface of the charging member. Alternatively, in Japanese Patent Application Laid-Open No. 2008-276026, roughening particles are dispersed in the surface layer of a charging member, so as to improve discharge non-uniformity caused by the increase in the electrical resistance value under the L/L environment.

SUMMARY OF THE INVENTION

As an example of the electroconductive member, a charging roller is disposed in an electrophotographic apparatus in such a way that it is in contact with a photosensitive drum and is used to perform electrical charging of the photosensitive drum with a DC voltage. The charging roller is often controlled for the electrical resistance value thereof by using an electron conducting agent such as carbon black. If an electron conducting agent is used, however, an abnormal discharge having an excessive charge amount may occur in a portion having a lower electrical resistance value caused by the aggregation of the electron conducting agent, and this abnormal discharge may lead to an image having a blank area or spot.

Since the charging roller may be dried to have a higher electrical resistance value under the L/L environment, a weak discharge may be liable to be intermittently caused, which may cause a horizontal streak-like image failure in some cases. Particularly when an ion conducting agent is used, it is known that the electrical resistance value of the charging roller is largely varied depending upon the water content of the charging roller, and as a result, there is a high possibility that a horizontal streak-like image failure is caused under the L/L environment.

In a case of a transfer roller as another example of the electroconductive member, similarly to the charging roller, a portion having a lower electrical resistance value may occur locally in the transfer roller due to the non-uniform dispersion of a conducting agent, or the electrical resistance value may be deviated from a proper region of the resistance depending on the use environment, and consequently, an abnormal transfer image may be formed.

Thus, for an electroconductive member for electrophotography, such as a charging roller or a transfer roller, it is necessary to achieve both reduction of the non-uniformity in the electrical resistance value of the electroconductive member due to the non-uniform dispersion of the conducting agent and inhibition of the variation in the electrical resistance value due to the use environment. Under the current circumstances where an electrophotographic apparatus is required of a higher speed and a longer life, however, there is a tendency that the proper region of the electrical resistance value or the available types of conducting agents, for achievement of both the reduction of the non-uniformity in the resistance value and the inhibition of the variation in the resistance value, are restricted, and there is a possibility that it might be difficult in the future to provide an electroconductive member capable of inhibiting an image failure in controlling only the electrical resistance value of the electroconductive member.

In general, the discharge characteristics of an electroconductive member are largely affected not only by the electrical resistance value of the electroconductive member but also by the surface shape of the electroconductive member. In other words, it is known that even when the electroconductive member is of a member constitution whose desired property cannot be easily attained by merely controlling the electrical resistance value, desired discharge characteristics can be realized by controlling the surface shape of the electroconductive member.

In case of the charging member of Japanese Patent Application Laid-Open No. H09-101650 including the raised electroconductive fiber entangled material on the surface thereof, if a large friction is caused between the photosensitive drum and the fiber entangled material at the time of start-up of an electrophotographic apparatus, the fiber entangled material is abraded or damaged during a long-term use at a high speed, which may cause an image failure in some cases. Moreover, Japanese Patent Application Laid-Open No. H09-101650 provides no solution to a problem occurring in forming a high resolution image finer than the fiber diameter of the fiber entangled material.

According to Japanese Patent Application Laid-Open No. 2008-276026, attempts are made to eliminate a horizontal streak-like image failure in the L/L environment in such a way as to inhibit the development of a discharge in the longitudinal direction of the charging member. When the charge potential is increased for purpose of forming a higher resolution image, however, further improvement is desired for inhibiting an abnormal discharge having an excessive discharge charge amount from occurring in a site having a lower electrical resistance value locally formed by an electron conducting agent.

The present invention was accomplished in consideration of the aforementioned technical background. An object of the present invention is to provide an electroconductive member having a discharge characteristic or an electric characteristic enabling a high resolution image to be output for a long period of time by controlling the surface shape of the electroconductive member.

Another object of the present invention is to provide an electroconductive member capable of inhibiting formation of an image having a blank area or spot arising from an abnormal discharge having an excessive discharge charge amount even if in the conductive member there is a portion or site having a lower electrical resistance value locally caused by the electron conducting agent.

Still another object of the present invention is to provide an electroconductive member capable of inhibiting a horizontal streak-like image failure caused by the magnitude of an electrical resistance value of the electroconductive member under the L/L environment.

Still another objet of the present invention is to provide an electroconductive member whose surface is less abraded and damaged by friction caused between the photosensitive drum and the electroconductive member at the time of start-up of an electrophotographic apparatus or during a long-term use.

Still another object of the present invention is to provide a process cartridge and an electrophotographic apparatus capable of stably forming high quality electrophotographic images for a long period of time.

The present invention provides an electroconductive member for electrophotography including: an electroconductive support layer; and a surface layer thereon, and the surface layer has a network structure containing fibers, the fibers having an arithmetic mean value $d^{U10}$ of top 10% fiber diameters, of 0.2 μm or more and 15.0 μm or less as measured at arbitrary 100 points in an SEM observed image of the fiber, the electroconductive support layer has a rigid structural body, and in a cross section in a thickness direction of the electroconductive member, the rigid structural body having a height of $1.0\times10^{-2}$ to $1.0\times10^{1}$ times as large as a thickness of the surface layer, and the surface layer satisfies the following (1) to (3):

(1) when the surface layer is observed in such a manner as to face the surface layer, one or more crossings of the fibers are observed in a square region having one side length of 1.0 mm on the surface of the surface layer;

(2) when the surface layer is observed in such a manner as to face the surface layer, at least a part of the rigid structural body is observed in a square region having one side length of 1.0 mm on the surface of the surface layer; and (3) when a Voronoi tessellation is performed with generating points, the generating points being the fibers exposed on a cross section in a thickness direction of the surface layer, each of areas of Voronoi polygons resulting from the Voronoi tessellation is defined as $S_1$, each of cross-sectional areas in the cross section of the fibers as the generating points of the respective Voronoi polygons is defined as $S_2$, and a ratio "$S_1/S_2$" is calculated, an arithmetic mean value $k^{U10}$ of the top 10% of the ratios is 40 or more and 160 or less.

Also, the present invention provides a process cartridge detachably mountable to a main body of an electrophotographic apparatus, including any of the above-described electroconductive member.

Furthermore, the present invention provides an electrophotographic apparatus including any of the above-described electroconductive member.

According to the present invention, an electroconductive member having a discharge characteristic and an electrical characteristic enabling higher definition images to be output over a long period of time at a higher speed can be provided by controlling the surface shape of the electroconductive member.

Also, the present invention can provide a process cartridge and an electrophotographic apparatus capable of stably forming higher quality electrophotographic images for a long period of time.

Further features of the present invention will become apparent from the following description of exemplary embodiments with reference to the attached drawings.

DESCRIPTION OF THE EMBODIMENTS

Figure 1:
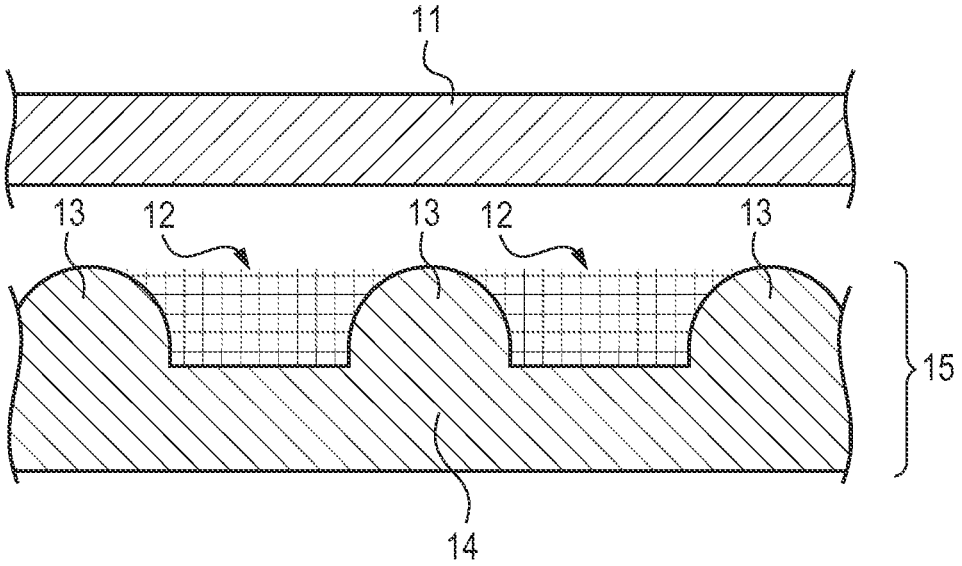
FIG. 1 is a schematic enlarged cross-sectional view of a portion in the vicinity of a nip between an electroconductive member according to an embodiment of the present invention and a member to be charged.

Preferred Embodiments of the present invention will now be described in detail in accordance with the accompanying drawings.

In an electroconductive member using an electron conducting agent, an abnormal discharge having an excessive discharge charge amount occurs easily because of a portion or site having a lower electrical resistance value locally formed due to aggregation of the conducting agent. Since the locally formed site having a lower electrical resistance value has a small time constant, it is presumed that the site has high performance of supplementing charges from a power source to the surface of the electroconductive member. Further, if a voltage is applied to an electroconductive member containing a conducting agent with a very low electrical resistance value dispersed in a resin with a high electrical resistance value, in consideration that charge is accumulated on the interface between the resin and the conducting agent, it is presumed that a larger amount of charges is involved in the discharge in the portion where the conducting agent is aggregated than in an electroconductive member in which the conducting agent is uniformly dispersed.

For the reasons set forth so far, in an electroconductive member using an electron conducting agent, it is presumed that an abnormal discharge having an excessive discharge charge amount occurs easily if a potential difference exceeding Paschen's law is formed in a space between the portion having a lower electrical resistance value and the photosensitive drum. As a result, a charge amount on the surface of the photosensitive drum is increased, resulting in a higher charge potential than in the surrounding area, which appears as a blank spot-like image failure. This abnormal discharge having an excessive discharge charge amount can be observed with a high-speed camera, and is known to have a size of approximately 200 μm to 700 μm. Further, the abnormal discharge is not caused under a condition of a small DC voltage because this discharge is a discharge having an excessive discharge charge amount, but is caused when an applied voltage is made greater in the magnitude to increase the discharge charge amount.

In consideration of the above-described mechanism by which the abnormal discharge occurs, it is presumed that the discharge charge amount may be reduced to inhibit the abnormal discharge. As a result of earnest studies, the present inventors have found that the abnormal discharge can be inhibited by constructing, as the surface of an electroconductive member, a surface layer having a network structure formed by fiber. The inventors have observed a discharge caused between the electroconductive member of the present invention and the photosensitive drum directly with a high-speed compact camera, confirming a phenomenon in which a single discharge is subdivided if there is a network structure formed by fiber on the circumference of the electroconductive support layer. This phenomenon is remarkably confirmed depending on the presence or absence of the surface layer.

The reason why the abnormal discharge can be inhibited is presumed as follows. First, in a discharge space, if the electric field exceeds Paschen's law in minute holes in the surface layer having the network structure formed by fibers, an air molecule present in the minute holes is ionized to generate an electron and a positive ion, resulting in causing the first discharge. Since this first discharge is caused in the minute holes having a small discharge space, this discharge is caused in a comparatively low electric field. Next, the generated electron moves toward the photosensitive drum in the holes of the network structure while colliding with a large number of molecules present in the air in moving according to the applied electric field and forming an electron avalanche. Since collision between the electrons and molecules always occurs at the tip of the electron avalanche, the electron avalanche develops while increasing the discharge charge amount, but since the network structure is present in the discharge space, the development of the discharge is inhibited. In other words, since the first discharge is caused in the minute holes at a small voltage, the discharge charge amount of a single discharge is controlled, and in addition, it is considered that the increase in the discharge charge amount through the development of the discharge can be also inhibited by the network structure.

As for advantages of introducing the network structure, a horizontal streak-like image failure, which is caused due to a weak discharge occurring because the electroconductive member is dried to have a higher electrical resistance value under the L/L environment, can be inhibited. The mechanism by which the weak discharge causing the horizontal streak-like image failure occurs is presumed as follows. The charge retention performance of the photosensitive drum is lowered through image formation performed for a long period of time, and charge potential decay is caused in a contact portion between the photosensitive drum and the charging member. In general, a discharge for charging the photosensitive drum is completed upstream of the contact portion, but if the charge potential decay is caused in the contact portion, a weak discharge is caused again downstream of the contact portion. This weak discharge has a property of developing in a direction vertical to the rotating direction of the photosensitive drum, and as a result, on the surface of the photosensitive drum, the charge potential becomes higher in a horizontal streak-like portion having had the weak discharge downstream of the contact portion than in the surrounding area, which is observed as a horizontal streak-like image failure.

The present inventors have found that the above-described horizontal streak-like image failure caused under the L/L environment can be inhibited by using a surface layer having a network structure formed by fiber. The reason is not clear but presumed as follows. As described above, the horizontal streak-like image failure is presumed to be caused because of a weak discharge occurring downstream of the contact portion between the electroconductive member and the photosensitive drum. If the surface layer is introduced to the surface of the electroconductive member, it is considered that a discharge caused by a small potential difference is completed in a minute hole of the surface layer and does not develop to the photosensitive drum. Further, it is also considered that the phenomenon of the development of the discharge in the direction vertical to the rotating direction of the photosensitive drum can be also inhibited by the network structure. Accordingly, it is presumed that, even if the electrical resistance value of the electroconductive member is increased because of dryness under the L/L environment, the horizontal streak-like image failure can be inhibited.

As described so far, when the surface layer having the network structure containing fibers is constructed, the inhibition of the formation of an image having a blank area or spot caused by the abnormal discharge can be realized, and a horizontal streak-like image failure caused by the L/L environment can be also inhibited. In addition, to exhibit these inhibition effects, it is considered that it is important that the surface layer is present in the discharge space as a structure partitioning the discharge space.

In order to actually incorporate the electroconductive member of the present invention into a process cartridge and use it as an electroconductive member for electrophotography, however, it is indispensable to improve the durability of the surface layer having the network structure containing fibers. This is because if the electroconductive member is used in a state of being in contact with a photosensitive drum, there is a possibility that the surface layer is abraded and damaged by a large frictional force caused in start-up of the process. Further, also in order to use the surface layer for a long period of time without impairing the function of the surface layer, it is necessary to improve the durability of the surface layer.

Figure 2:
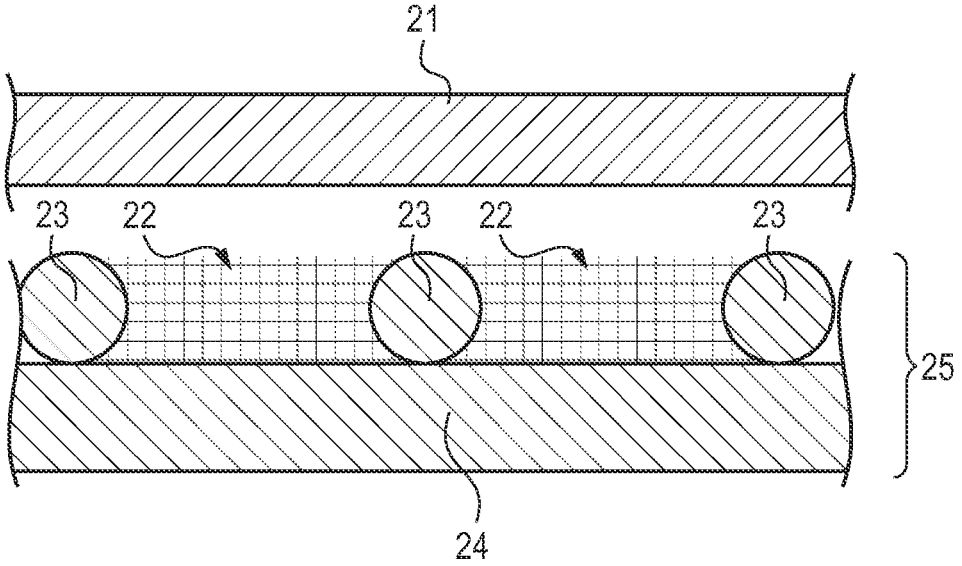
FIG. 2 is a schematic enlarged cross-sectional view of a portion in the vicinity of a nip between an electroconductive member according to another embodiment of the present invention and a member to be charged.

The present inventors have made earnest examinations on the durability of the surface layer having the network structure formed by fiber, and as a result, have found that it is effective to form a rigid structural body on the surface of the electroconductive member as illustrated in FIG. 1 and FIG. 2.

Specifically, FIG. 1 is an enlarged cross-sectional view of a portion in the vicinity of a nip formed between an electroconductive member 15 according to an embodiment of the present invention and a member 11 to be charged disposed as opposed to the electroconductive member 15. Although in FIG. 1 there is provided a gap between the electroconductive member 15 and the member 11 to be charged for convenience, the electroconductive member 15 and the member 11 to be charged is actually brought into contact with each other at the time of charging the member 11. In FIG. 1, reference numeral 14 denotes an electroconductive support layer, reference numerals 13 denotes rigid structural bodies integrated with the electroconductive support layer 14, and reference numerals 12 denote a surface layer having a network structure disposed between a plurality of the rigid structural bodies 13.

FIG. 2 is an enlarged cross-sectional view of a portion in the vicinity of a nip formed between an electroconductive member 25 according to another embodiment of the present invention and a member 21 to be charged disposed as opposed to the electroconductive member 25. In the same manner as in FIG. 1, although in FIG. 2 there is a gap between the member 21 to be charged and the electroconductive member 25 for convenience, the electroconductive member 25 and the member 21 to be charged is actually brought into contact with each other in charging the member 21. In FIG. 2, reference numeral 24 denotes an electroconductive support layer, and reference numerals 23 denote a rigid structural body provided on the electroconductive support layer 24 as a member separated from the electroconductive support layer 24. Reference numerals 22 denote a surface layer having a network structure present between a plurality of the rigid structural bodies 23.

It was found that the electroconductive member of the present invention can largely decrease, owing to the rigid structural body provided on the electroconductive support to be integrally with the electroconductive support or as a member separated from the electroconductive support, the possibilities of deformation, abrasion and damage of the network structure of the surface layer otherwise caused through friction caused in the start-up of the process or friction with the photosensitive drum for a long period of time.

According to the electroconductive member of the present invention, since the rigid structural body function as a spacer between the electroconductive member and a member to be charged (such as a photosensitive drum), the frictional force applied to the network structure can be largely reduced.

Further, it is considered that the rigid structural body has an additional effect to complement the function of the surface layer having the network structure containing fibers. In the case where the abnormal discharge is inhibited by the surface layer, the surface layer preferably has a large electrical resistance value for suppressing a discharge charge amount of a discharge occurring in a minute hole. If the electrical resistance value of the surface layer is increased, however, the electroconductive member is prompted to have a high electrical resistance value, which may cause a horizontal streak-like image failure. Here, in consideration of the fact that the rigid structural body has a function of providing irregularities on the surface of the electroconductive member to subdivide, in a time-wise manner, a discharge from the surface of the electroconductive member to the photosensitive drum, it is considered that also the rigid structural body can inhibit the discharge from developing in the direction vertical to the rotating direction of the photosensitive drum. Accordingly, when the rigid structural body and the surface layer having the network structure containing fibers are both used, the disadvantage such that a horizontal streak-like image failure can be easily caused by a high electrical resistance value of the network structure can be avoided.

For the reasons set forth above, even in using a member constitution whose intended purpose cannot be easily attained by merely controlling the electrical resistance value of the electroconductive member, the incorporation of a rigid structural body into the surface layer having a network structure containing fibers on the surface of electroconductive member can provide an electroconductive member showing a stable discharge characteristic for a long period of time. Here, a stable discharge characteristic means that not only a blank spot-like image failure caused by the abnormal discharge occurring from a portion locally having a lower electrical resistance value but also a horizontal streak-like image failure caused by a weak discharge occurring due to increase of the electrical resistance value of the electroconductive member under the L/L environment can be simultaneously inhibited.

The present invention will now be described in detail.

In the case where the electroconductive member of the present invention is a roller-shaped electroconductive member, the x-axis direction, the y-axis direction and the z-axis direction mean the following directions: The x-axis direction means a lengthwise direction of the roller. The y-axis direction means a tangential direction on a cross section (namely, a circular cross section) of the roller perpendicular to the x-axis. The z-axis direction means a diameter direction on the cross section of the roller perpendicular to the x-axis.

An "xy plane" means a plane perpendicular to the z-axis, and a "yz cross section" means a cross section perpendicular to the x-axis. Since a minute region on the surface of the surface layer can be regarded substantially as a plane perpendicular to the z-axis, a "square with a side of 1.0 mm on the surface of the surface layer" means a square on the "xy plane" having a side of 1.0 mm along the x-axis direction and a side of 1.0 mm along the y-axis direction.

A "thickness direction" of the electroconductive member and a "thickness direction" of the surface layer mean the z-axis direction unless otherwise specified.

Figure 3A:
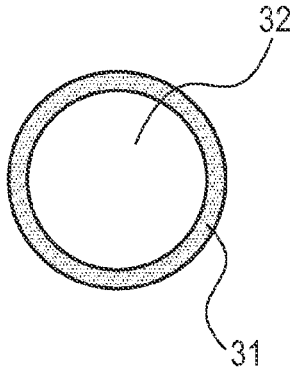
FIG. 3A is a schematic cross-sectional view of an example of an electroconductive member according to the present invention.
Figure 3B:
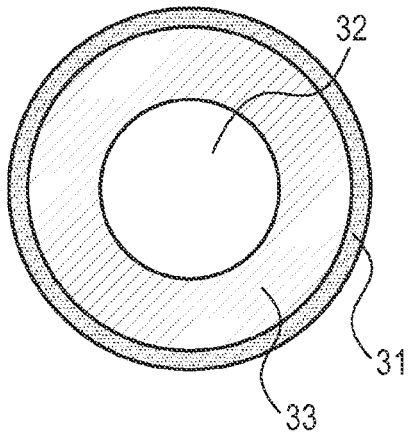
FIG. 3B is a schematic cross-sectional view of another example of the electroconductive member according to the present invention.

FIG. 3A and FIG. 3B are schematic diagrams of the cross section (the yz cross section) of a roller-shaped electroconductive member of the present invention. This electroconductive member includes an electroconductive support layer and a surface layer formed on the circumference of the electroconductive support layer and having a network structure formed by fiber, and a rigid structural body is present between the electroconductive support layer and the surface layer. The constitutions illustrated in FIGS. 3A and 3B can be shown as examples of the structure of the electroconductive member.

The electroconductive member of FIG. 3A includes an electroconductive support layer made of a mandrel 32 corresponding to a conductive mandrel, and a surface layer 31 provided on the circumference of the electroconductive support layer and having a network structure formed by fiber. In this case, the rigid structural body is present on the circumference of the mandrel 32, and may have a structure integrated with the mandrel 32 or have a structure independent of the mandrel 32. Further, the rigid structural body may have a structure integrated with the surface layer 31 or have a structure independent of the surface layer 31.

The electroconductive member of FIG. 3B includes an electroconductive support layer containing a mandrel 32 as a conductive core rod and an electroconductive resin layer 33 provided on the circumference of the mandrel, and a surface layer 31 provided on the circumference of the electroconductive support layer. As long as the effects of the present invention are not impaired, a multilayered structure using a plurality of electroconductive resin layers 33 may be employed if necessary. In this case, the rigid structural body is present on the circumference of the electroconductive resin layer 33, and may have a structure integrated with the electroconductive resin layer 33 or have a structure independent of the electroconductive resin layer 33. Further, the rigid structural body may have a structure integrated with the surface layer 31 or have a structure independent of the surface layer 31.

<Electroconductive Support Layer>

[Conductive Mandrel]

As a material for forming the conductive mandrel, any material can be appropriately selected from those known in the field of electroconductive members for electrophotography. An example of the material includes a carbon steel alloy column having, on a surface thereof, a nickel plating with a thickness of approximately 5 μm.

[Electroconductive Resin Layer]

As a material for forming the electroconductive resin layer of the present invention, a rubber material, a resin material or the like can be used. The rubber material is not especially limited, and any of rubbers known in the field of electroconductive members for electrophotography can be used, and specific examples include the following: An epichlorohydrin homopolymer, an epichlorohydrin-ethylene oxide copolymer, an epichlorohydrin-ethylene oxide-allyl glycidyl ether terpolymer, an acrylonitrile-butadiene copolymer, a hydrogenated product of an acrylonitrile-butadiene copolymer, silicone rubber, acrylic rubber, and urethane rubber. Also as the resin material, any resins known in the field of electroconductive members for electrophotography can be used, and specific examples include the following: An acrylic resin, polyurethane resin, polyamide resin, polyester resin, polyolefin resin, an epoxy resin, and a silicone resin. To a rubber material or a resin material used for forming the electroconductive resin layer, carbon black having electron conductivity; graphite; an oxide such as tin oxide; a metal such as copper or silver; a conductive particle provided with conductivity by coating the particle surface with an oxide or a metal; or an ion conducting agent having ion exchange performance, such as a quaternary ammonium salt or a sulfonate having ion conductivity, may be added for adjusting the electrical resistance value if necessary. Further, as long as the effects of the present invention are not impaired, a generally used compounding agent for a rubber or a resin, such as a filler, a softener, a processing aid, a tackifier, an anti-adhesion agent, a dispersant, a foaming agent, or a roughening particle can be added.

As the electroconductive resin layer of the present invention, in consideration of dependency of the electrical resistance value on the use environment, an electroconductive resin layer having volume resistivity of $1\times10^3$ Ω·cm or more and $1\times10^9$ Ω·cm or less and showing electron conductivity can be used. A harmful effect on an image derived from non-uniform dispersion of an electron conducting agent, which is a disadvantage of an electroconductive resin showing electron conductivity, can be inhibited by the discharge stabilizing effect of the surface layer having the network structure formed by fiber of the present invention.

<Surface Layer>

The surface layer of the electroconductive member of the present invention is a layer formed on the circumference or the surface of the electroconductive support layer, and has a network structure formed by fiber.

[Fiber]

The fiber for forming the network structure of the surface layer of the present invention has a length larger than a fiber diameter by 100 or more times. The fiber diameter and the fiber length can be verified by observing the network structure of the surface layer with an optical microscope or the like. The cross sectional shape of the fiber is not especially limited, and can be a circular, elliptical, square, polygonal, semicircular or arbitrary cross sectional shape. Incidentally, the fiber diameter used herein means, if the cross sectional shape of the fiber is a circle, the diameter of the circle, and if the cross sectional shape of the fiber is not a circle, the length of the longest straight line passing through the center of gravity of the cross section.

[Fiber Diameter]

The fiber forming the network structure of the surface layer of the present invention has an arithmetic mean value $d^{U10}$ of top 10% fiber diameters of 0.2 μm or more and 15.0 μm or less. Since the surface layer forms the outermost layer of the electroconductive member, if the diameter of the fiber forming the surface layer is too large, the pattern of the fiber may appear as image irregularities in outputting a printed image in some cases, and in addition, since a hole contained in the network structure is large, there is a possibility that the effect of subdividing the abnormal discharge may be reduced. With respect to the phenomenon in which the pattern of the fiber appears as the image irregularities, also when the fiber partially has a thicker portion, there is a possibility that the portion may appear as the image irregularities, and hence, the arithmetic mean value $d^{U10}$ is 15.0 μm or less, preferably 11.0 μm or less, and more preferably 1.3 μm or less. If the arithmetic mean value $d^{U10}$ is 15.0 μm or less, the pattern of the fiber becomes difficult to be seen as image irregularities. Further, if the arithmetic mean value $d^{U10}$ is 11.0 μm or less, the number of holes larger than approximately 200 to 700 μm, that is, the size of an abnormal discharge, can be largely reduced, and hence, the occurrence of an image having a blank spot caused by the abnormal discharge can be reduced. If the arithmetic mean value $d^{U10}$ is more preferably 1.3 μm or less, the pattern of the fiber is less seen as image irregularities regardless of the resolution in outputting a printed image, and at the same time, since the size of all the holes within the surface layer can be made 100 μm, the abnormal discharge inhibiting effect is greatly improved. On the other hand, if the arithmetic mean value $d^{U10}$ is smaller than an ultra-fine fiber diameter of 0.2 μm, although the abnormal discharge subdividing effect can be attained, there is a high possibility that electron avalanches may merge with each other again immediately after the subdivision, and consequently, the arithmetic mean value $d^{U10}$ is preferably 0.2 μm or more.

The arithmetic mean value "$d^{U10}$" refers to a fiber diameter which can be determined by the following method. First, a scanning electron microscope (SEM) is used for observing the surface layer of the electroconductive member from a direction facing the surface thereof, and fiber diameters are measured at arbitrary 100 points in an SEM-observed image. Subsequently, from the thus measured fiber diameters at the 100 points, fiber diameters at 10 points corresponding to top 10% of larger fiber diameters are selected, and a mean value of the selected diameters is calculated.

The fiber diameter may be measured at arbitrary points in the SEM-observed image, and in order to avoid bias in the measurement points, for example, with the SEM-observed image divided vertically into 5 to 20 regions and horizontally into 20 to 5 regions, one point of the fiber having a substantially circular cross section is arbitrarily selected in each of 100 divided regions thus obtained, so as to measure the fiber diameter in the selected point.

[Resin Material]

The fiber for forming the network structure of the surface layer of the present invention is not especially limited as long as a fibrous structure can be formed, and an organic material including a resin material, an inorganic material such as silica or titania, or a hybrid material of the organic material and the inorganic material may be used.

Examples of the resin material include the following: Polyolefin-based polymers such as polyethylene and polypropylene; polystyrene; polyimide, polyamide and polyamideimide; polyarylenes (aromatic polymers) such as polyparaphenylene oxide, poly(2,6-dimethylphenylene oxide) and polyparaphenylene sulfide; a polyolefin-based polymer, polystyrene, polyimide or a polyarylene (an aromatic polymer) into which a sulfonic acid group (—$SO_3H$), a carboxyl group (—COOH), a phosphate group, a sulfonium group, an ammonium group or a pyridinium group is introduced; fluorine-containing polymers such as polytetrafluoroethylene and polyvinylidene fluoride; a perfluorosulfonic acid polymer, a perfluorocarboxylic acid polymer or a perfluorophosphoric acid polymer obtained by introducing a sulfonic acid group, a carboxyl group or a phosphate group into a skeleton of a fluorine-containing polymer; polybutadiene-based compounds; polyurethane-based compounds in the form of an elastomer and a gel; silicone-based compounds; polyvinyl chloride; polyethylene terephthalate; nylon; and polyalylate. One of these polymers may be singly used, or a plurality of these may be used in combination, and a specific functional group may be introduced into a polymer chain, or a copolymer produced by combining two or more monomers used as materials of these polymers may be used.

Examples of the inorganic material include oxides and the like of Si, Mg, Al, Ti, Zr, V, Cr, Mn, Fe, Co, Ni, Cu, Sn and Zn, and more specific examples include the following metal oxides: Silica, titanium oxide, aluminum oxide, alumina sol, zirconium oxide, iron oxide and chromium oxide.

In addition, the surface layer can be made of a material having high adhesion to the electroconductive support layer. If a material having high adhesion to the electroconductive support layer is used, an electroconductive member laminated and bonded without using a bonding agent (a pressure sensitive adhesive) can be formed. For this purpose, the fiber material can partly have a polar functional group.

[Additive]

In the surface layer having the network structure formed by the fiber, as long as the effects of the present invention are not impaired and as long as the network structure can be formed, an additive can be added to the resin material for adjusting the electrical resistance value. Examples of the additive include the following: Carbon black and graphite having electron conductivity; an oxide such as tin oxide; a metal such as copper or silver; a conductive particle provided with conductivity by coating the particle surface with an oxide or a metal; and an ion conducting agent having ion exchange performance, such as a quaternary ammonium salt or a sulfonate having ion conductivity. Further, as long as the effects of the present invention are not impaired, a filler, a softener, a processing aid, a tackifier, an anti-adhesion agent or a dispersant generally used as a compound agent for a resin can be added.

The electric characteristic, in terms of volume resistivity, of the surface layer formed by the fiber can be $1\times10^5$ Ωcm to $1\times10^{15}$ Ωcm. If the resistivity of the surface layer is $1\times10^5$ Ωcm or more, a discharge charge amount from the surface layer can be decreased so as to inhibit the abnormal discharge. On the other hand, if the volume resistivity of the surface layer is $1\times10^{15}$ Ωcm or less, the electrical resistance value of the network structure as a layer can be reduced, so that a horizontal streak-like image failure can be inhibited under the L/L environment.

The volume resistivity of the fiber forming the network structure can be measured by collecting the fiber with tweezers or the like from the surface layer of the electroconductive member, bringing a single piece of the fiber into contact with a cantilever of a scanning probe microscope (SPM), and sandwiching the single piece of the fiber between the cantilever and an electroconductive substrate. Alternatively, the fiber may be similarly collected from the surface layer, and the fiber is melted by heating or by using a solvent to be formed into a sheet shape, and then the volume resistivity of the sheet can be measured.

[Network Density of Surface Layer]

In the surface layer of the electroconductive member of the present invention, it is necessary that, when the surface layer is observed in such a manner as to face the surface layer, the number of crossings of the fibers (hereinafter sometimes referred to as the "network density") observed in a square region having one side length of 1.0 mm on the surface (the xy plane) of the surface layer should be one or more.

Here, it has been found through direct observation of discharge light that the size of the abnormal discharge having an excessive discharge charge amount is approximately 200 to 700 μm. In order to subdivide the abnormal discharge by the surface layer to suppress the discharge charge amount of a single discharge, the size of a region surrounded by the network structure can be equal to or smaller than the size of the abnormal discharge. Since the abnormal discharge is caused in the vertical direction to the surface of the electroconductive member (the z-axis direction), if the region surrounded by the network structure is equal to or smaller than the size of the abnormal discharge when the surface layer is observed from a direction facing the surface layer, the abnormal discharge inhibiting effect can be attained. In other words, it is important in the present invention to control the network density of the surface layer. Here, when a normal discharge having a small discharge charge amount is observed, the size of the discharge light is 30 to 70 μm.

Further, also in order to improve a horizontal streak-like image failure caused because the electrical resistance value of the electroconductive member is increased under the L/L environment, it is important to control the network density of the surface layer. In order to inhibit the horizontal streak-like image failure, a weak discharge with a small potential difference can be completed within a hole of the network structure, and at the same time, for subdividing a discharge in the shape of a horizontal streak in a discharge space even under conditions where a discharge to a photosensitive drum is easily caused, a hole in the network structure can be made smaller to increase the network density. In other words, it is presumed that the number of crossings between the fiber in the surface layer can be suitably increased.

The network density of the surface layer is calculated by observing, from the direction vertical to the surface of the surface layer (the z-axis direction), arbitrary 100 points of square regions each having a side of 1.0 mm by using an optical microscope, a laser microscope or the like. If one or more crossings of the fibers are observed in each of all the 100 measurement points, a huge discharge can be divided and subdivided. At that time, although an observed image includes information resulting from integrating all pieces of information along the thickness direction (the z-axis direction) of the network structure, the subdivision of a discharge size is affected by the network density of the surface layer including the information along the layer thickness direction, and consequently, this determination method of the present invention is regarded as suitable.

Although the measurement points for the network density are arbitrarily determined, in order to avoid bias in the measurement points, for example, with the surface layer of the electroconductive member divided in the lengthwise direction into equal 5 to 25 regions and in the circumferential direction into equal 20 to 4 regions, an arbitrary one point in each of 100 divided regions thus obtained (namely, 100 points in total) may be selected as the measurement point.

From the viewpoint of subdividing the abnormal discharge having an excessive discharge charge amount, the network density at each measurement point is preferably 100 (meshes/$mm^2$) or more, and more preferably 1,000 (meshes/$mm^2$) or more. If the density is 100 or more, the abnormal discharge having a size of approximately 200 to 700 μm can be subdivided into a size of a normal discharge. Further, if the network density at each measurement point is 1,000 (meshes/$mm^2$) or more, the number of holes where a weak discharge occurs can be increased, and consequently, the function to inhibit the horizontal streak-like image failure under the L/L environment is greatly increased.

[Three-Dimensional Structure of Surface Layer]

In the surface layer of the electroconductive member of the present invention, it is important that the fiber is three-dimensionally arranged to provide a structure with an extremely large porosity. It is considered that a state in which a space within the surface layer is partitioned by a fiber group is important for the exhibition of the effect of subdividing the abnormal discharge having an excessive discharge charge amount and the effect of inhibiting development of a weak discharge. Accordingly, it is preferred to quantitatively determine the fiber group present in the surface layer and the partitioned space within the surface layer formed by the fiber group.

The present inventors have defined the structure of the surface layer as described below from the viewpoints of the fibers and spaces occupied by the fibers. First, the surface layer is cut out from the electroconductive member, and a cross-sectional image of the cross section (either the yz cross section or the xz cross section) of the surface layer is obtained with X-ray CT. The thus obtained cross-sectional image is binarized to extract a cross-sectional image of the fibers, and a fiber cross-sectional image group in the cross-sectional image is subjected to the Voronoi tessellation, so as to define spaces within the surface layer occupied by each cross section of the fibers.

Here, the Voronoi tessellation is to classify a plurality of points (generating points) placed at arbitrary positions on a plane into regions depending on which one of the generating points any other point on the same metric space is close to. In particular, in the case of a two-dimensional Euclidean plane, the Voronoi tessellation is an approach involving drawing a perpendicular bisector on a straight line connecting the centers of gravity of generating points adjacent to each other and dividing the nearest region of each fiber with the perpendicular bisector. In addition, the nearest region of each generating point obtained by performing the Voronoi tessellation is called a Voronoi polygon. It is because the perpendicular bisector of the respective generating points adjacent to each other is unambiguously determined and hence the Voronoi polygon is also unambiguously determined that the Voronoi tessellation is employed.

The present inventors have actually performed the Voronoi tessellation in the following manner: First, two straight lines, which are perpendicular to the z-axis, are included in two intersection lines between two planes passing through centers of gravity of fiber cross sections disposed at the uppermost end and the lowermost end in the fiber cross-sectional (yz cross sectional) image and the fiber cross section (the yz cross section), and have a length the same as the width of the fiber cross-sectional image, were drawn to be included in the fiber cross-sectional image. Here, the uppermost end and the lowermost end in the fiber cross-sectional image are as follows: in the cross-sectional image obtained before cutting out only the fiber cross-sectional image, a fiber cross-section whose shortest distance from the electroconductive support layer is largest in the fiber cross-sectional image group is defined as the uppermost end, and a fiber cross-section whose shortest distance is smallest is defined as the lowermost end. Then, these two straight lines were defined as "boundaries of an occupied region of the surface layer", and a rectangle formed by linking, with straight lines, the ends on the same side of the two straight lines to each other was defined as "the occupied region of the surface layer". Next, the Voronoi tessellation using a fiber cross section as a generating point was performed in the occupied region. Such procedures were employed for the following reason: Fiber cross sections disposed in the uppermost position and the lowermost position in the cross-sectional image can define a region dividing line against adjacent fibers along a direction parallel to the surface of the electroconductive member (i.e., the y-axis direction), but along a direction vertical to the surface of the electroconductive member (i.e., the z-axis direction), cannot form a region dividing line because the number of generating points is insufficient in this direction. In addition, also in the case where the surface layer has a small thickness, a state where a plurality of fiber cross sections are present in the direction vertical to the surface of the electroconductive member in the cross-sectional image cannot be established unless the above-described measures are taken, and hence, a Voronoi polygon cannot be disadvantageously defined for some of generating points in this case.

As a result of earnest studies made by the present inventors, it has been found that it is important to optimize a ratio "$S_1/S_2$" (hereinafter sometimes referred to as the "area ratio k") between an area $S_1$ of each of Voronoi polygons in the yz cross section obtained by the aforementioned method and a cross sectional area $S_2$ in the fiber cross section as a generating point of each of the Voronoi polygons. That is, if a Voronoi polygon is too large as compared with each of the fibers in the surface layer, the subdividing effect is so small that the abnormal discharge and the weak discharge cannot be inhibited. On the other hand, if a Voronoi polygon is too small as compared with each of the fibers in the surface layer, the porosity of the network structure is so small that some portions on the surface of the photosensitive drum cannot be sufficiently discharged, and hence, a charge potential forms a pattern of the fibers, which also causes a fibrous image failure in a resultant image.

Specifically, if the arithmetic mean value $k^{U10}$ of top 10% area ratios k is 160 or less, holes larger than the size of the abnormal discharge (of approximately 200 to 700 μm) are less formed, and hence the abnormal discharge can be easily inhibited. On the other hand, if the arithmetic mean value $k^{U10}$ is 40 or more, a charge failure and a pattern of the fiber are little output directly in an image. For these reasons, the arithmetic mean value $k^{U10}$ is preferably 40 or more and 160 or less. The arithmetic mean value $k^{U10}$ is more preferably 60 or more and 160 or less. If the arithmetic mean value $k^{U10}$ is 60 or more and 160 or less, the abnormal discharge subdividing effect is greatly increased.

[Thickness of Surface Layer]

As described above, in order to exhibit the effect of inhibiting the abnormal discharge, it is important that the surface layer having the network structure is present in a discharge space between the electroconductive member and the photosensitive drum. Since the abnormal discharge is caused in the direction vertical to the surface of the electroconductive member, the thickness of the surface layer having the network structure is important, and the surface layer has preferably an average thickness $t_s$ of 10 μm or more and 400 μm or less. If the average thickness is 10 μm or more, an effect of further subdividing and further stabilizing the discharge can be attained. On the other hand, if the average thickness is 400 μm or less, a charge failure caused by insulation of the electroconductive member can be prevented.

In the present invention, in order that a stable discharging characteristic can be retained even if the surface layer having the network structure formed by the fiber is worn away or worn out due to a long-term use, the average thickness of the surface layer is preferably 50 μm or more and 400 μm or less.

The "thickness of the surface layer" means a length, in the vertical direction to the surface (the z-axis direction), from the surface of the electroconductive support layer to the position where the fiber forming the surface layer having the network structure formed by the fiber is present. The "average thickness" means a mean value of measured values of the thickness of the surface layer measured at arbitrary 10 points. This average thickness can be determined by cutting out, from the electroconductive member, a section including the electroconductive support layer and the layer of the network structure to be subjected to measurement by the X-ray CT.

Although the measurement points for the thickness of the surface layer are arbitrarily determined, in order to avoid bias in the measurement points, for example, with the surface layer of the electroconductive member divided in the lengthwise direction into equal 10 regions, an arbitrary one point in each of the 10 regions thus obtained (10 points in total) may be selected as the measurement point.

[Method for Forming Surface Layer]

A method for forming the surface layer having the network structure of the present invention is not especially limited, and for example, the following method can be employed: A raw material is formed into a shape of fiber by an electrospinning method (an electric field spinning method, an electrostatic spinning method), a conjugate fiber spinning method, a polymer blend spinning method, a melt-blow spinning method, a flash spinning method or the like, and the resulting fiber is laminated on the electroconductive support layer. All fiber shaped products obtained by the aforementioned methods have a sufficient length as compared with the fiber diameter.

Incidentally, the electrospinning method is a method for producing fiber in which a high voltage is applied between a material solution put in a syringe and a collector electrode, so that the solution extruded from the syringe can be charged and scattered in the electric field to be thinned into the shape of fiber and adhered to the collector. Among the aforementioned methods for producing fine fiber, the electrospinning method is preferred.

Figure 4:
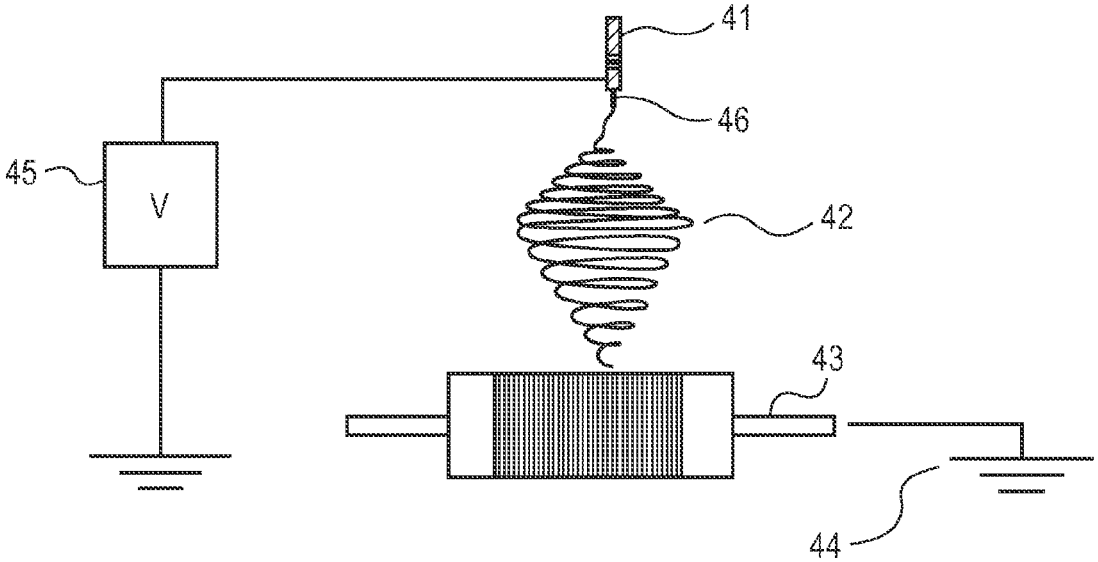
FIG. 4 is a schematic diagram of an apparatus used for performing an electrospinning.

A method for producing a layer of the network structure by the electrospinning method will be described with reference to FIG. 4. The electrospinning method is performed by using a high voltage power source 45, a storage tank 41 for a material solution, a spinning nozzle 46, and a collector 43 connected to ground 44. The material solution is extruded from the tank 41 to the spinning nozzle 46 at a constant speed. A voltage of 1 to 50 kV is applied to the spinning nozzle 46, and when the electrical attraction exceeds the surface tension of the material solution, a jet 42 of the material solution is ejected toward the collector 43. At that time, a solvent contained in the jet 42 is gradually evaporated, and when the jet 42 reaches the collector 43, the size of the jet 42 is reduced to nano size.

A method for preparing the material solution is not especially limited, and any of conventional methods can be appropriately employed. The type of the solvent and the concentration of the solution are not especially limited, and can be set to meet optimum conditions for the electrospinning. Alternatively, instead of the material solution, a molten material heated to a temperature equal to or higher than the melting point can be used.

The network structure used in the present invention can be obtained by controlling the fiber diameter of the fiber forming the network structure, and the network density and the thickness of the network structure. The fiber diameter of the fiber, and the network density and the thickness of the network structure can be controlled in the following manner.

First, the fiber diameter of the fiber can be controlled mainly through a solid content concentration of the material, and the fiber diameter can be reduced by lowering the solid content concentration. As another means, the fiber diameter can be reduced by increasing the voltage applied in spinning or by reducing the volume of the jet 42 to increase the electrical attraction. Further, the network density can be controlled mainly with the aid of the applied voltage.

Specifically, when the applied voltage is increased, the electrical attraction can be increased to increase the density. Other than the applied voltage, the density can be increased by elongating the spinning duration time or increasing the ejecting speed. Furthermore, the thickness of the network structure is in proportion to the spinning duration time. Accordingly, the thickness of the network structure can be increased by elongating the spinning duration.

In the present invention, the electroconductive member in which the surface layer having the network structure is coated on the circumference of the electroconductive support layer can be directly produced by using the electroconductive support layer as the collector. In this case, the surface layer is seamless. Incidentally, in some methods for forming the surface layer, there is a possibility that a seam may be formed. For example, in a method in which a film of the network structure is formed once and then the electroconductive support layer is coated with this film, a seam is formed in the layer of the network structure. Since the seam portion has a larger thickness than the other portions, an image failure can be caused in the seam portion in some cases. Accordingly, the surface layer having the network structure is preferably seamless.

The electroconductive support layer and the surface layer can be directly laminated to each other, or can be laminated and bonded to each other by using a bonding agent (a pressure sensitive adhesive), and any of conventional methods can be appropriately employed. If these layers are laminated and bonded to each other by using a bonding agent, adhesion between the electroconductive support layer and the surface layer can be easily improved, resulting in an electroconductive member with higher durability.

[Rigid Structural Body]

If the electroconductive member is a charging member used in contact with, for example, a photosensitive drum, the rigid structural body used in the present invention refers to a structure whose deformation volume caused through the contact with the photosensitive drum is smaller than the average fiber diameter in the surface layer.

[Density of Rigid Structural Bodies]

The introduction of the rigid structural body onto a circumferential portion of the electroconductive support layer leads to two advantages. Specifically, the advantages are an effect of protecting the surface layer having the network structure formed by the fiber, and an auxiliary effect of inhibiting a horizontal streak-like image failure under the L/L environment of the surface layer.

The first advantage is the effect of protecting the surface layer. In consideration of the practical use of the surface layer, it is regarded that the surface layer may be damaged or abraded through contact or friction with the photosensitive drum. Specifically, there is a concern about abrasion caused by large frictional force occurring at the time of start-up of the process or by a long-term use. If the rigid structural bodies are provided at an appropriate density on the circumferential portion of the electroconductive support layer, the rigid structural bodies work as a spacer between the electroconductive member and the photosensitive drum, so as to retain a minute gap between the electroconductive support layer and the photosensitive drum. Consequently, the damage and the abrasion of the photosensitive drum and the surface layer can be reduced.

In order to attain such an effect of protecting the surface layer, it is necessary to optimize the density of the rigid structural bodies so as not to break the minute hole present in the surface layer. The "density of the rigid structural bodies" means the number of rigid structural bodies (mesh/$mm^2$) observed in a square region having one side length of 1.0 mm on the surface (the xy plane) of the surface layer when the surface layer is observed from a direction facing the surface layer. The present inventors have found it preferable that at least a part of the rigid structural bodies can be observed in a square region having one side length of 1.0 mm on the surface of the surface layer when observed from the direction facing the surface layer.

The second advantage is the auxiliary effect of the surface layer of inhibiting a horizontal streak-like image failure under the L/L environment. The abnormal discharge inhibiting effect exhibited by the surface layer is remarkably shown when the discharge charge amount of a discharge is suppressed in a hole by increasing the electrical resistance value of the surface layer. If the electrical resistance value of the surface layer is increased, however, the electrical resistance value of the electroconductive member is increased under the L/L environment, which leads to a concern that the horizontal streak-like image failure may be urged to occur. The rigid structural bodies are provided on the circumferential portion of the electroconductive support layer at an appropriate density to form surface irregularities, and thus, a discharge from the surface of the electroconductive member to the photosensitive drum can be divided in a time-wise manner. The "division of a discharge in a time-wise manner" means that the discharge gap is made non-uniform by the irregular structure, and also that discharges in directions vertical to the rotating direction of the photosensitive drum are prevented from occurring at the same time. In order to achieve this effect, the density of the rigid structural bodies can be 100 meshes/$mm^2$ or more.

The density of the rigid structural bodies is calculated by observing, with an optical microscope, a laser microscope or the like, arbitrary 100 square regions with four (4) sides of 1.0 mm each from the direction vertical (the z-axis direction) to the surface of the electroconductive support layer. If one or more parts of the rigid structural bodies can be observed in each of all the 100 measurement points, a discharge to propagate into the shape of a horizontal streak can be divided.

If the rigid structural body is in a continuous shape, the density of the rigid structural body is defined as follows. First, arbitrary 100 square regions with a side of 1.0 mm are observed with an optical microscope, a laser microscope or the like from the vertical direction (the z-axis direction) to the surface of the electroconductive support layer. Next, each of the 100 square regions with a side of 1.0 mm is divided vertically into equal 100 regions and horizontally into equal 100 regions, namely, into 10,000 minute regions in total. Among these minute regions, the number of minute regions where a part of the rigid structural body is observed is defined as the density of the rigid structural body in the observation region.

Although the measurement points for the density of the rigid structural bodies are arbitrarily determined, in order to avoid bias in the measurement points, for example, with the surface layer of the electroconductive member divided in the longitudinal direction into equal 5 to 25 regions and in the circumferential direction into equal 20 to 4 regions, an arbitrary one point in each of 100 divided regions thus obtained (namely, 100 points in total) may be selected as the measurement point.

[Relationship Between Average Height of Rigid Structural Bodies and Average Thickness of Surface Layer]

On the circumferential portion of the electroconductive support layer, in a cross section along the thickness direction of the surface layer, there are present the rigid structural bodies having a height $1.0\times10^{-2}$ to $1.0\times10^{1}$ times as large as the thickness of the surface layer. It is important to appropriately set the ratio "$h_s/t_n$" between an average height "$h_r$" of the rigid structural bodies and an average thickness "$t_s$" of the surface layer to reduce the damage and the abrasion of the surface layer. Here, the average height "$h_r$" of the rigid structural bodies is calculated based on cross-sectional profile data obtained from a group of arbitrarily selected 100 rigid structural bodies by using a laser microscope or the like. First, a laser microscope is used for obtaining a convex upward cross-sectional profile with a length of 0.5 mm in which the highest point of each rigid structural bodies is positioned at the center on a plane passing through highest points of the respective rigid structural bodies and being parallel to the z-axis. After obtaining the cross-sectional profile, a difference between the maximum value and the minimum value in the profile is defined as the height of the rigid structural body. Then, an arithmetic mean value of the heights of the arbitrary 100 rigid structural bodies is defined as the average height of the rigid structural bodies.

Although the measurement points for the height of the rigid structural body are arbitrarily determined, in order to avoid bias in the measurement points, for example, with the surface layer of the electroconductive member divided in the longitudinal direction into equal 5 to 25 regions and in the circumferential direction into equal 20 to 4 regions, an arbitrary one point in each of 100 divided regions thus obtained (namely, 100 points in total) may be selected as the measurement point.

The present inventors have found that the above-described effects of the rigid structural body can be attained when the ratio "$h_s/t_n$" is $1.0\times10^{-2}$ to $1.0\times10^{1}$. If the ratio is $1.0\times10^{-2}$ or more, the damage and the abrasion of the surface layer otherwise caused by the friction occurring at the time of start-up of the process or by a long-term use can be inhibited. On the other hand, if the ratio is $1.0\times10^{1}$ or less, the discharge gap can be prevented from becoming too large and hence the abnormal discharge can be easily inhibited. Incidentally, if the ratio "$h_s/t_n$" is larger than 1.0, the average height of the rigid structural bodies is larger than the average thickness of the outer surface of the surface layer, and hence, this case corresponds to a state where tips of the rigid structural body are present outside the outer surface of the surface layer.

The relationship between the rigid structural body and the surface layer is additionally described.

The rigid structural body can be made of the same material as the fiber of the network structure, and the rigid structural bodies can be connected to one another via the fiber of the network structure. In this case, since the rigid structural bodies and the layer of the network structure are connected to each other, the layer of the network structure is less likely to peel off from the electroconductive support layer, and the damage of the network structure can be advantageously reduced.

Further, the rigid structural bodies can be in the form of fiber, and an arithmetic mean fiber diameter of the rigid structural bodies can be larger than an arithmetic mean fiber diameter of the fiber forming the network structure. In this case, the distribution of the arithmetic mean values of the heights of the rigid structural bodies is narrower than in the case where the rigid structural bodies are in the form of a particle or the like, and hence, the contact pressure is uniform, resulting advantageously in more uniform charging of the photosensitive drum.

Method for Forming Rigid Structural Body

The rigid structural body formed integrally with the electroconductive support layer and the rigid structural body formed independently of the electroconductive support layer can be formed, for example, in the following manner.

[Rigid Structural Body Formed Integrally with Electroconductive Support Layer]

In employing the configuration of FIG. 3A, a method for forming the surface of the electroconductive support layer 32 into an irregular shape may be employed. For example, any method for forming irregularities on the surface of the electroconductive support layer 32, including, but not limited to, sand blasting, laser processing, mechanical polishing and chemical polishing, can be employed.

In employing the configuration of FIG. 3B, a method for forming the surface of the electroconductive resin layer 33 into an irregular shape may be employed. Examples include a method in which irregularities are formed on the surface by subjecting the electroconductive resin layer 33 to sand blasting, laser processing, polishing or the like, and a method in which a filler such as an organic particle or an inorganic particle is dispersed in the electroconductive resin layer 33. Examples of the material of the organic particle include the following: Nylon, polyethylene, polypropylene, polyester, polystyrene, polyurethane, a styrene-acrylic copolymer, polymethyl methacrylate, an epoxy resin, a phenol resin, a melamine resin, cellulose, polyolefin and a silicone resin. Further, examples of the material of the inorganic particle include the following: Silicon oxide such as silica, aluminum oxide, titanium oxide, zinc oxide, calcium carbonate, magnesium carbonate, aluminum silicate, strontium silicate, barium silicate, calcium tangstate, a clay mineral, mica, talc and kaolin.

[Rigid Structural Body Formed Independently of Electroconductive Support Layer]

Examples of a method for causing the rigid structural body to be supported on the electroconductive support layer 32 independently of the electroconductive support layer 32 include a method in which a fine powder is applied on the surface of the electroconductive support layer 32, a method in which fiber having a larger arithmetic mean fiber diameter than the arithmetic mean fiber diameter of the fiber forming the surface layer is formed, and a method in which a bead structure obtained by an electrospinning method is formed. Further, the bead structure obtained by the electrospinning method means a spherical structure generated in a process for spinning fiber depending on spinning conditions in the electrospinning method.

If the fine powder is applied to the circumference of the electroconductive support layer, examples of the fine powder include an organic powder and an inorganic powder. Examples of the materials of the organic powder and the inorganic powder are the same as those of the material of the organic powder and the material of the inorganic powder described above. Examples of a production method to be employed in applying the fine powder include, but are not limited to, a method in which the electroconductive support layer is pressed against the fine powder spread on a plane, and a method in which the fine powder is adhered after coating the electroconductive support layer with an adhesive layer.

Examples of the material of the fiber thicker than the fiber forming the surface layer and the material of the bead structure are not limited as long as the shape of the thick fiber and the bead structure can be formed, and the following organic materials and inorganic materials can be used.

Examples of the organic material include the following: Polyolefin-based polymers such as polyethylene and polypropylene; polystyrene; polyimide, polyamide and polyamideimide; polyarylenes (aromatic polymers) such as polyparaphenylene oxide, poly(2,6-dimethylphenylene oxide) and polyparaphenylene sulfide; a polyolefin-based polymer, polystyrene, polyimide or a polyarylene (an aromatic polymer) into which a sulfonic acid group (—$SO_3H$), a carboxyl group (—COOH), a phosphate group, a sulfonium group, an ammonium group or a pyridinium group is introduced; fluorine-containing polymers such as polytetrafluoroethylene and polyvinylidene fluoride; a perfluorosulfonic acid polymer, a perfluorocarboxylic acid polymer or a perfluorophosphoric acid polymer obtained by introducing a sulfonic acid group, a carboxyl group or a phosphate group into a skeleton of a fluorine-containing polymer; polybutadiene-based compounds; polyurethane-based compounds in the form of an elastomer and a gel; silicone-based compounds; polyvinyl chloride; polyethylene terephthalate; nylon; and polyalylate. One of these polymers may be singly used, or a plurality of these may be used in combination, and a specific functional group may be introduced into a polymer chain, or a copolymer produced by combining two or more monomers used as materials of these polymers may be used.

Examples of the inorganic material include oxides and the like of Si, Mg, Al, Ti, Zr, V, Cr, Mn, Fe, Co, Ni, Cu, Sn and Zn, and specific examples include the following metal oxides: Silica, titanium oxide, aluminum oxide, alumina sol, zirconium oxide, iron oxide and chromium oxide.

A method for producing the fiber thicker than the fiber forming the surface layer is not especially limited, and an example includes the following: A method in which a raw material is formed into a shape of fiber by the electrospinning method (an electric field spinning method, an electrostatic spinning method), a conjugate fiber spinning method, a polymer blend spinning method, a melt-blow spinning method, a flash spinning method or the like, and the resulting fiber is laminated on the surface of the electroconductive support layer. Incidentally, the fiber thicker than the fiber forming the surface layer can be thick fiber having an arithmetic mean value $d_{L10}$ of bottom 10% fiber diameters larger than the arithmetic mean value $d^{U10}$ of top 10% fiber diameters of the surface layer. The arithmetic mean value $d_{L10}$ is a value obtained as a mean value of 10 fiber diameters corresponding to the bottom 10% of the measured fiber diameters among fiber diameters measured in arbitrary 100 points.

With respect to the production condition for the bead structure obtained by the electrospinning method, the following is generally known. The bead structure can be obtained by lowering a voltage applied between the spinning nozzle 46 and the collector 43 or by increasing a speed of ejecting a coating material solution from the spinning nozzle as compared with a reference condition for obtaining a uniform fiber shape.

The production method and the material of the rigid structural body are not limited to those described above, and in consideration of the durability of the surface layer, a configuration in which the rigid structural body is integrated with the electroconductive support layer is preferably employed. In consideration of peeling of the rigid structural body off from the circumference of the electroconductive support layer, a configuration in which the configuration of FIG. 3B is employed and a filler of an organic particle, an inorganic particle or the like is dispersed in a surface portion of the electroconductive resin layer 33 is more preferably employed.

<Process Cartridge>

Figure 5:
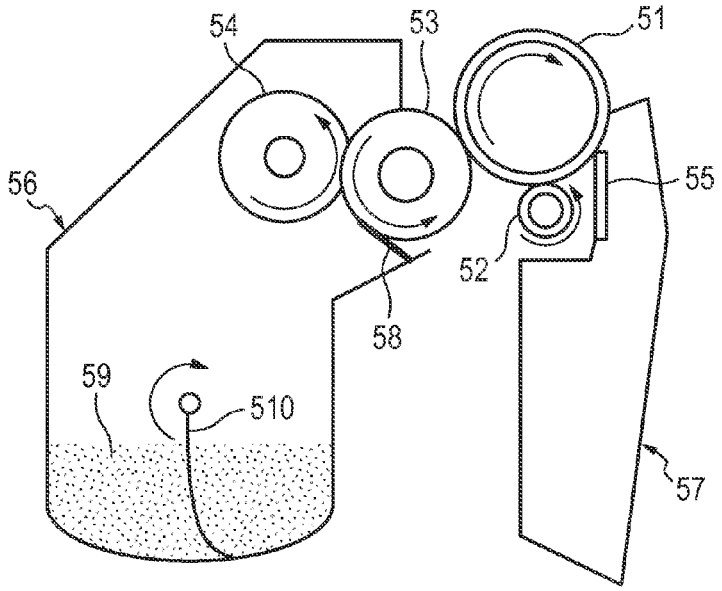
FIG. 5 is an explanatory diagram of a process cartridge using the electroconductive member according to the present invention.

FIG. 5 is a schematic cross-sectional view of a process cartridge for electrophotography using the electroconductive member of the present invention as a charging roller and the like. This process cartridge is realized by integrating a developing unit and a charging unit, and is designed to be removable from an image forming apparatus. The developing unit includes at least a developing roller 53 and a toner container 56 integrated with each other, and may further include, if necessary, a toner supply roller 54, a toner 59, a developing blade 58 and an impeller 510. The charging unit includes at least a photosensitive drum 51, a cleaning blade 55 and a charging roller 52 integrated with one another, and may further include a waster toner container 57. A voltage is respectively applied to the charging roller 52, the developing roller 53, the toner supply roller 54 and the developing blade 58.

<Electrophotographic Apparatus>

Figure 6:
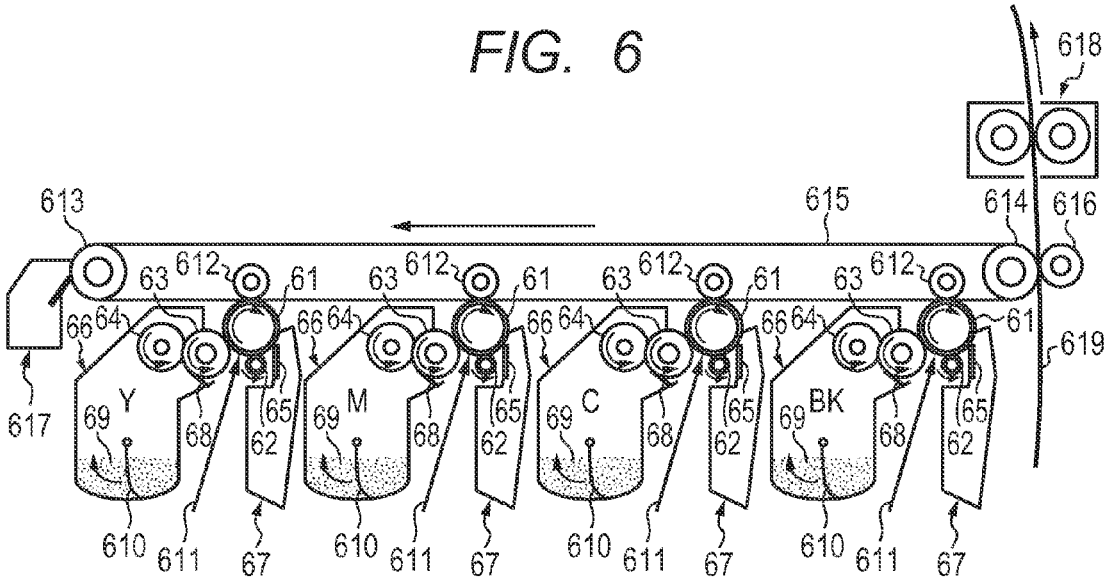
FIG. 6 is an explanatory diagram of an electrophotographic apparatus using the electroconductive member according to the present invention.

FIG. 6 is a schematic diagram illustrating the configuration of an electrophotographic image forming apparatus using the electroconductive member of the present invention as a charging roller and the like. This electrophotographic image forming apparatus is a color image forming apparatus in which four process cartridges described above are removably attached. The process cartridges respectively use toners of colors of black, magenta, yellow and cyan. A photosensitive drum 61 is rotated in an arrow direction to be uniformly charged by a charging roller 62 to which a voltage is applied by a charging bias power source, and an electrostatic latent image is formed on the surface of the photosensitive drum by exposing light 611. On the other hand, a toner 69 contained in a toner container 66 is supplied to a toner supply roller 64 by an impeller 610 to be conveyed onto a developing roller 63. Then, the toner 69 is uniformly coated on the surface of the developing roller 63 by a developing blade 68 disposed in contact with the developing roller 63, and a charge is applied to the toner 69 by frictional charging. The electrostatic latent image is provided with the toner 69 conveyed by the developing roller 63 disposed in contact with the photosensitive drum 61 to be developed, so as to be visualized as a toner image.

The toner image visualized on the photosensitive drum is transferred by a primary transfer roller 612, to which a voltage is applied by a primary transfer bias power source, onto an intermediate transfer belt 615 supported and driven by a tension roller 606 and an intermediate transfer belt driving roller 607. The toner images of the respective colors are successively superimposed, resulting in forming a color image on the intermediate transfer belt.

A transfer material 619 is fed into the apparatus by a paper feed roller and conveyed to a portion between the intermediate transfer belt 615 and a secondary transfer roller 616. To the secondary transfer roller 616, a voltage is applied by a secondary transfer bias power source, so as to transfer the color image formed on the intermediate transfer belt 615 onto the transfer material 619. The transfer material 619 onto which the color image has been transferred is subjected to a fixing process by a fixing unit 618, the resultant is ejected to the outside of the apparatus, and thus, a printing operation is completed.

On the other hand, the toner not transferred but remaining on the photosensitive drum is scraped off by the cleaning blade 65 to be contained in the waste toner container 67, and the thus cleaned photosensitive drum 61 is repeatedly used for the above-described process. Further, the toner not transferred but remaining on the primary transfer belt is also scraped off by a cleaning unit 617.

EXAMPLES

The present invention will now be more specifically described with reference to examples.

Example 1

1. Preparation of Unvulcanized Rubber Composition

Materials whose kinds and amounts are shown in Table 1 below were mixed by using a pressure kneader to obtain an A-stage kneaded rubber composition. Furthermore, 166 parts by mass of the A-stage kneaded rubber composition was mixed with materials whose kinds and amounts are shown in Table 2 below by using an open roll, so as to prepare an unvulcanized rubber composition.

TABLE 1

| | Material | Content (parts by mass) |
|---|---|---|
| Raw rubber | NBR (trade name: Nipol DN219 manufactured by Zeon Corporation) | 100 |
| Conducting agent | Carbon black (trade name: Tokablack #7360SB manufactured by Tokai Carbon Co., Ltd.) | 40 |
| Filler | Calcium carbonate (trade name: Nanox #30 manufactured by Maruo Calcium Co., Ltd.) | 20 |
| Vulcanization acceleration assistant | Zinc oxide | 5 |
| Processing aid | Stearic acid | 1 |

TABLE 2

| | Material | Content (parts by mass) |
|---|---|---|
| Crosslinking agent | Sulfur | 1.2 |
| Vulcanization acceleration assistant | Tetrabenzylthiuram disulfide (trade name: TBZTD manufactured by Sanshin Chemical Industry Co., Ltd.) | 4.5 |

2. Preparation of Electroconductive Roller

2-1. Mandrel

A round bar, having a length of 252 mm and an outer diameter of 6 mm, of free-cutting steel whose surface had been subjected to electroless nickel plating was prepared. Next, a roller coater was used for applying, as a bonding agent, Metaloc U-20 (trade name, manufactured by Toyokagaku Kenkyusho Co., Ltd.) over a whole circumferential surface portion with a length of 230 mm of the round bar excluding both end portions each having a length of 11 mm. In this example, the round bar thus coated with the bonding agent was used as a conductive mandrel.

2-2. Electroconductive Elastic Layer

Next, a die having an inner diameter of 12.5 mm was attached to a tip of a cross head extruder equipped with a mechanism for supplying the conductive mandrel and a mechanism for discharging an unvulcanized rubber roller, and the temperatures of the extruder and the cross head were set to 80° C. and the conveyance speed of the conductive mandrel was adjusted to 60 mm/sec. Under these conditions, the unvulcanized rubber composition was supplied from the extruder to cover the circumferential portion of the conductive mandrel with the unvulcanized rubber composition in the cross head, and thus, an unvulcanized rubber roller was obtained. Next, the unvulcanized rubber roller was put in a hot-air vulcanizing furnace at 170° C. for vulcanizing the rubber composition by heating for 60 minutes, and thus, a roller having an electroconductive elastic layer on the circumferential portion of the mandrel was obtained. Thereafter, end portions of the electroconductive elastic layer were removed by cutting off by 10 mm each, so as to attain a length of the electroconductive elastic layer portion in the lengthwise direction of 231 mm. Ultimately, the surface of the electroconductive elastic layer was polished by a rotating grindstone. In this manner, an electroconductive elastic roller 1A having a diameter, measured in positions away from a center portion toward respective ends by 90 mm, of 8.4 mm and a diameter in the center portion of 8.5 mm was obtained.

2-3. Electroconductive Resin Layer

Next, an electroconductive resin layer was provided on this electroconductive elastic roller 1A in the manner described below. First, methyl isobutyl ketone was added to a caprolactone-modified acrylic polyol solution to adjust the resultant solid content to 10% by mass. To 1,000 parts by mass of the thus obtained acrylic polyol solution (having a solid content of 100 parts by mass), materials shown in Table 3 below were added to obtain a mixed solution. Here, the mixture of a block HDI and a block IPDI was added in the ratio of "NCO/OH=1.0".

TABLE 3

| Material | Content (parts by mass) |
|---|---|
| Caprolactone-modified acrylic polyol solution | 100 (solid content) |
| Carbon black (HAF) | 15 |
| Needle-like rutile type titanium oxide fine particle | 35 |
| Modified dimethyl silicone oil | 0.1 |
| Mixture of butanone oxime block products of hexamethylene diisocyanate (HDI) and isophorone diisocyanate (IPDI) in 7:3 | 80.14 |

Next, 210 g of the aforementioned mixed solution was mixed with 200 g of glass beads having an average particle size of 0.8 mm used as a medium in a 450 mL glass bottle, and the resultant mixture was subjected to pre-dispersion for 24 hours by using a paint shaker dispersing machine to obtain a pre-dispersed coating liquid. Further, to the pre-dispersed coating liquid, 19.2 g of a crosslinking acrylic particle (trade name: GR300W, manufactured by Negami Chemical Industrial Co., Ltd.) was added, the resultant was subjected to post-dispersion for 10 minutes, and thus, a coating material 1 for forming an electroconductive resin layer was obtained.

The electroconductive elastic roller 1A was immersed, with the longitudinal direction thereof set to the vertical direction, in the coating material 1 for forming an electroconductive resin layer to be coated by a dipping method. The immersion time for the dip coating was 9 seconds, and the lifting speed was set to 20 mm/sec at the initial stage and to 2 mm/sec at the final stage and was linearly changed over time between these stages. The thus obtained coated product was air-dried at ordinary temperature for 30 minutes, subsequently dried for 1 hour in a hot air circulating dryer set to 90° C., and further dried for 1 hour in a hot air circulating dryer set to 160° C. In this manner, an electroconductive roller 1B in which an electroconductive resin layer was formed on the circumference of the electroconductive elastic roller and roughening particles were contained as the rigid structural bodies in the electroconductive resin layer was obtained.

3. Preparation of Coating Liquid for Forming Surface Layer

To 7.5 g of a polyamideimide solution of polyamideimide (PAI) dissolved in a mixed solvent of methyl pyrrolidone (MNP) and xylene (manufactured by Toyobo Co., Ltd.: VYLOMAX HR-13NX, having a solid content concentration of 30% by mass), 2.5 g of dimethylformamide (DMF) was added to adjust the resultant solid content to 22.5% by mass. In this manner, a coating liquid 1 for forming a surface layer was prepared.

4. Production of Electroconductive Member

Next, the electrospinning method was performed for spraying the coating liquid 1, and the thus produced fine fiber was directly wound around the electroconductive roller 1B attached as the collector, so as to produce an electroconductive member 1 having a network structure on the outer circumference of the electroconductive support layer.

Specifically, first, the electroconductive roller 1B was attached as a collector of an electrospinning apparatus (trade name: NANON, manufactured by Mec Co., Ltd.). Next, the coating liquid 1 was filled in a tank. Then, under application of a voltage of 25 kV to a spinning nozzle, the coating liquid 1 was sprayed in the amount of 1 ml/hr toward the electroconductive roller 1B with the spinning nozzle laterally moved at 50 mm/sec. At that time, the electroconductive roller 1B used as the collector was rotated at 1,000 m/s. By spraying the coating liquid 1 for 90 seconds, an electroconductive member 1 having a layer of a network structure was obtained.

5. Evaluation of Characteristics

Next, the obtained electroconductive member 1 was subjected to the following evaluation tests. The evaluation results are shown in Table 8.

[5-1. Measurement of Electrical Resistance Value of Fiber]

As a method for measuring the volume resistivity of the fiber forming the surface layer, a scanning probe microscope (SPM) (trade name: Q-Scope 250, manufactured by Quesant Instrument Corporation) was used for measurement in a contact mode. The fibers of the surface layer were collected from the electroconductive member with tweezers, and the collected fibers were placed on a metal plate of stainless steel. Next, one of the fibers in direct contact with the metal plate was selected and brought into contact with a cantilever of the SPM, and a voltage of 50 V was applied to the cantilever for measuring a current value. Next, the surface shape of the fiber was observed with the SPM, and based on the thickness of the fiber obtained at a measurement point and the contact area with the cantilever, the volume resistivity of the fiber was calculated.

The above-described measurement was performed in an arbitrary one point in each of five regions obtained by dividing the surface layer of the electroconductive member in the longitudinal direction (the x-axis direction) into equal 5 regions. An arithmetic mean value of the volume resistivities thus obtained in the 5 points was defined as the volume resistivity of the surface layer.

[5-2. Measurement of Fiber Diameter]

For measuring fiber diameters of the fibers forming the network structure, a scanning electron microscope (SEM) (trade name: S-4800, manufactured by Hitachi High-Technologies Corporation) was used for observation at 2000-fold magnification. The surface layer of the electroconductive member was observed with the SEM from a direction facing to the surface thereof to obtain an SEM observed image. From each of 100 regions of the SEM observed image as obtained by dividing the image vertically into equal 10 regions and horizontally into equal 10 regions, one point of the fiber having a cross section close to a circular shape was selected, and the fiber diameter of the selected fiber was measured. Subsequently, from the thus measured fiber diameters of 100 fibers, 10 fiber diameters corresponding to top 10% of larger fiber diameters were selected, and a mean value of the selected fiber diameters was calculated as an arithmetic mean value $d^{U/10}$ of the top 10%.

[5-3. Measurement of Network Density of Surface Layer]

The network density of the surface layer was measured at the following measurement point from the direction facing the surface layer (the z-axis direction) by using a laser microscope (trade name: LSM5•PASCAL, manufactured by Carl Zeiss). The surface layer was divided longitudinally into equal 25 regions and circumferentially into equal 4 regions, and an arbitrary one point in each of the thus obtained 100 regions was set as the measurement point. From each of these measurement points (100 points in total), a square region having the following size was arbitrarily selected, and it was confirmed whether or not one or more crossings of the fibers were observed in the square region, so as to make the evaluation based on the following criteria:

Rank A: One or more crossings of the fibers are observed in all of (100) square regions with a side of 100

Rank B: One or more crossings of the fibers are observed in all of (100) square regions with a side of 200

Rank C: One or more crossings of the fibers are observed in all of (100) square regions with a side of 1.0 mm.

Rank D: No crossings of the fibers are observed in some of (100) square regions with a side of 1.0 mm.

[5-4. Measurement of Thickness of Surface Layer]

The surface layer of the electroconductive member was cut with a razor into a section having dimensions in the x-axis direction and the y-axis direction of 250 μm for each direction and a depth in the z-axis direction of 700 μm including the rubber roller as the electroconductive support layer. Next, the section was subjected to three-dimensional reconstruction by using an X-ray CT imaging apparatus (trade name: TX-300, manufactured by Tohken Co., Ltd.). From the thus obtained three-dimensional image, 50 two-dimensional slice images (in parallel to the xy plane) were cut out at an interval of 1 μm against the z-axis. Next, these slice images were binarized to discriminate between a fiber portion and a hole portion. In each of the binarized slice images, a ratio $R_f$ (%) occupied by the fiber portion was digitized, and a point at which the ratio $R_f$ became equal to or less than 2% in checking values of the ratio from the electroconductive support layer toward the surface layer was defined as an outermost surface of the layer having the network structure. In this manner, the thickness of the surface layer was measured.

The aforementioned operation was performed at an arbitrary one point in each of 10 regions of the surface layer as obtained by dividing the layer longitudinally into equal 10 regions (in 10 points in total) to obtain an average thickness $t_s$ of the surface layer.

[5-5. Measurement of Area Ratios Obtained by Voronoi Tessellation]

The surface layer of the electroconductive member was cut with a razor into a section having a dimension in the x-axis direction of 1 mm, a dimension in the y-axis direction of 0.5 mm and a depth in the z-axis direction of 700 μm including the rubber roller as the electroconductive support layer. Next, the section was subjected to three-dimensional reconstruction by using the X-ray CT imaging apparatus (trade name: TX-300, manufactured by Tohken Co., Ltd.). A group of 20 two-dimensional slice images (in parallel to the yz plane) was cut out from the resultant three-dimensional image at an interval of 3 μm against the x-axis.

Figure 7:
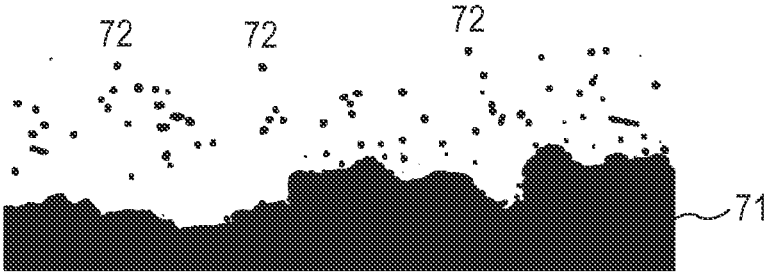
FIG. 7 is a diagram of an example of a binary image of a cross section of fiber forming a network structure of a surface layer.

First, one slice image was selected from the group of slice images, and the brightness and the contrast of the slice image was changed to the extent that the size of a fiber cross sectional image was not changed, by using image processing software, Imageproplus ver. 6.3 (manufactured by Media Cybernetics Inc.), and a binary image was obtained by performing binarization so that a fiber cross-sectional image group and the electroconductive support layer were in black. An example of the actually obtained binary image is illustrated in FIG. 7, in which a reference numeral 71 denotes the electroconductive support layer and a reference numeral 72 denotes a fiber cross-sectional image group.

Next, only a cross-sectional image of the fibers was cut out from the binary image by using a paint application supplied with Windows® 7 manufactured by Microsoft Corporation to obtain a fiber cross-sectional image (yz cross section). Further, two straight lines, which were perpendicular to the z-axis, were included in two intersection lines between two planes passing through centers of gravity of fiber cross sections disposed at the uppermost end and the lowermost end in the fiber cross section (yz cross section) and the fiber cross section (the yz cross section), and had a length the same as the width of the fiber cross-sectional image, were drawn to be included in the fiber cross-sectional image. Here, with respect to the uppermost end and the lowermost end in the fiber cross-sectional image, in the cross-sectional image obtained before cutting out only the fiber cross-sectional image, the fiber cross-section whose shortest distance from the electroconductive support layer is largest in the fiber cross-sectional image group is referred to as the uppermost end, and the fiber cross-section whose shortest distance is smallest is referred to as the lowermost end. Then, a rectangle formed by linking, with straight lines, the ends of the two straight lines to each other is defined as an occupied region of the surface layer.

Figure 8:
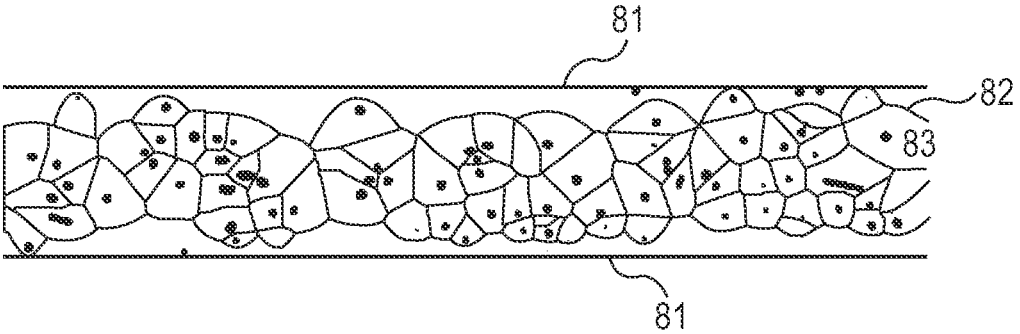
FIG. 8 is a diagram of an example of an image of the cross sections of the fibers resulting from a Voronoi tessellation.

Subsequently, the above-described image processing software was used for performing the Voronoi tessellation on the yz cross section in the occupied region by pruning processing using the group of fiber cross sections (on the yz cross section) as generating points. An example of a diagram resulting from the Voronoi tessellation is illustrated in FIG. 8. In FIG. 8, reference numerals 81 denote the two parallel straight lines used for defining the occupied region, a reference numeral 82 denotes a boundary of Voronoi polygons, and a reference numeral 83 denotes the group of fiber cross sections. Then, the area ratio k between the area $S_1$ of each of the resulting from Voronoi polygons and the cross-sectional area $S_2$ in the cross section of the fiber as the generating point of each of the Voronoi polygons was calculated, and an arithmetic mean value $k^{U/10}$ of top 10% of the area ratios k was obtained. Further, an average value of the area ratios k was obtained.

[5-6. Measurement of Density of Rigid Structural Bodies]

First, the surface layer was peeled off from the electroconductive member. Next, the density of the rigid structural bodies was measured from the direction vertical to the surface of the surface layer (in the z-axis direction) at the following measurement point by using a laser microscope (trade name: LSM5•PASCAL, manufactured by Carl Zeiss). The surface layer was divided longitudinally into equal 25 regions and circumferentially into equal 4 regions, and an arbitrary one point in each of the thus obtained 100 regions was set as the measurement point. In each of these measurement points (100 points in total), a square region having the following size was arbitrarily selected, and it was confirmed whether or not one or more rigid structural bodies were observed in the square region, so as to make the evaluation based on the following criteria:

Rank A: One or more rigid structural bodies are observed in all of (100) square regions with a side of 100 μm.

Rank B: One or more rigid structural bodies are observed in all of (100) square regions with a side of 200 μm.

Rank C: One or more rigid structural bodies are observed in all of (100) square regions with a side of 1.0 mm.

Rank D: No rigid structural body is observed in some of (100) square regions with a side of 1.0 mm.

[5-7. Measurement of Ratio Between Average Height $h_r$ of Rigid Structural Bodies and Average Thickness $t_s$ of Surface Layer]

First, the rigid structural bodies were observed by using the aforementioned laser microscope from the direction vertical to the surface (the z-axis direction) of the surface layer peeled off from the electroconductive member as described in [5-6] above. In the measurement with the laser microscope, a cross-sectional profile of the rigid structural bodies can be obtained based on laser reflection intensity. First, the surface layer was divided longitudinally into equal 25 regions and circumferentially into equal 4 regions, and from each of 100 regions thus obtained, an arbitrary one rigid structural body (100 rigid structural bodies in total) was selected. Subsequently, by using the laser microscope, a difference between a maximum value and a minimum value in the cross-sectional profile over 0.5 mm, having the highest point of the 100 rigid structural bodies at the center, was defined as the height of the rigid structural body, and an arithmetic mean value of the heights of the 100 rigid structural bodies was obtained as an average height $h_r$ of the rigid structural bodies. Subsequently, based on this value and the average thickness $t_s$ of the surface layer obtained in [5-4] above, a ratio therebetween, "$h_r/t_s$", was determined.

[5-8. Evaluation of Durability of Surface Layer]

In order to confirm the durability of the surface layer, a change in the thickness of the surface layer was evaluated in performing [6-2. Evaluation of image failure after endurance test] as described later. After the endurance test, a process cartridge was dismantled to take out the electroconductive member, and a thickness $t_{s2}$ of the surface layer after the endurance test was determined by using the aforementioned X-ray CT imaging apparatus (TX-300). Next, with the thickness of the surface layer before the endurance test set as $t_{s1}$, a ratio therebetween, "$t_{s2}/t_{s1}$", was determined in percentage.

6. Image Evaluation

The electroconductive member 1 was subjected to the following evaluation tests. The evaluation results are shown in Table 5.

[6-1. Evaluation of Blank Spot-Like Image Failure at Initial Stage]

This evaluation was made for confirming the effect of the electroconductive member of the present invention of stabilizing a discharge at an initial stage. As the electrophotographic apparatus, an electrophotographic laser printer (trade name: Laserjet CP4525dn manufactured by Hewlett-Packard Development Company, L.P.) was prepared. This apparatus had been, however, modified so that the number of A4-size paper sheets to be output could be 50 sheets/min, namely, so that the sheet output speed could be 300 mm/sec. Further, this laser printer had an image resolution of 1,200 dpi.

The electroconductive member 1 was incorporated as the charging roller into a process cartridge for the above-described laser printer, and the process cartridge was attached to the laser printer. Then, the laser printer was used for outputting a half-tone image under the L/L environment (an environment of a temperature of 15° C. and a relative humidity of 10%). Incidentally, the half-tone image used herein refers to an image in which horizontal lines having a width of 1 dot and an interval of 2 dots are drawn along a direction vertical to the rotating direction of the photosensitive member. The thus obtained half-tone image was visually observed to be evaluated based on the following criteria:

Rank A: No blank spot is observed in the image.

Rank B: A slight blank spot is partially observed in the image.

Rank C: A slight blank spot is wholly observed over the image.

Rank D: A serious blank spot is observed and conspicuous in the image.

[6-2. Evaluation of Image Failure Caused after Endurance Test]

Next, the above-described laser printer was used for performing an endurance test under the L/L environment. In the endurance test, 40,000 electrophotographic images were output by repeating an intermittent image formation operation in which the rotation of the photosensitive drum was completely stopped for approximately 3 seconds after outputting 2 images and then the image output was resumed. The image output in this case was an image in which a 4-point size alphabet "E" was printed at a coverage of 4% in an area of an A4-size paper sheet (hereinafter also referred to as the "letter E image").

After outputting 40,000 letter E images, the process cartridge was taken out of the laser printer, and the process cartridge was dismantled to take out the electroconductive member 1 used as the charging roller, and the electroconductive member was allowed to stand still for 48 hours or more under the L/L environment. Subsequently, the resultant electroconductive member 1 was incorporated again into the process cartridge as the charging roller, and the process cartridge was attached to the laser printer. By using this laser printer, a half-tone image was output under the L/L environment. The thus obtained half-tone image was visually observed, and it was evaluated whether or not a blank spot-like image failure and a horizontal streak-like image failure were caused therein, so as to make evaluation based on the following criteria.

[Evaluation of Blank Spot-Like Image Failure]

Rank A: No blank spot is observed in the image.

Rank B: A slight blank spot is partially observed in the image.

Rank C: A slight blank spot is wholly observed over the image.

Rank D: A serious blank spot is observed and conspicuous in the image.

[Evaluation of Horizontal Streak-Like Image Failure]

Rank A: No horizontal streak-like image is formed.

Rank B: Slight horizontal streak-like white line is partially observed in the print area.

Rank C: Slight horizontal streak-like white line is wholly observed over the print area.

Rank D: Serious horizontal streak-like white line is observed and conspicuous in the print area.

Example 2 to Example 30

Electroconductive members were produced and evaluated in the same manner as in Example 1 except that any one of coating liquids 1 to 9 each having a composition shown in Table 4 was used as the coating liquid for forming the surface layer, and that the average particle size and the amount of the crosslinking acrylic particles (the roughening particles) used as the rigid structural bodies were changed as shown in Tables 6 to 8. The evaluation results are shown in Tables 11 to 13. It is noted that Examples 2 to 30 corresponds to examples in which the production conditions were changed without mainly changing the materials of the surface layer and the rigid structural bodies.

TABLE 4

| Coating liquid No. | Fiber material | Product name | Solvent | Additional component | Solid content concentration (mass %) |
|---|---|---|---|---|---|
| 1 | PAI | "VYLOMAX HR-13NX" (trade name; manufactured by Toyobo Co., Ltd.) | DMF | — | 22.5 |
| 2 | | | | | 17 |
| 3 | | | | | 26 |
| 4 | | | | | 30 |
| 5 | SiO2 | "Flessela" (trade name; manufactured by Panasonic Electric Works Co., Ltd.) | IPA | — | 34 |
| 6 | PEO | Polyethylene oxide (manufactured by Tokyo Chemical Industry Co., Ltd., molecular weight: 900,000) | Water | — | 6 |
| 7 | PEO | Polyethylene oxide (manufactured by Tokyo Chemical Industry Co., Ltd., molecular weight: 900,000) | Water | KFBS 5 phr | 7.1 |
| 8 | PVDF-HFP | "KYNAR 2851" (trade name; manufactured by ARKEMA) | DMAc | CB 5 phr | 2.5 |

TABLE 4-continued

| Coating liquid No. | Fiber material | Product name | Solvent | Additional component | Solid content concentration (mass %) |
|---|---|---|---|---|---|
| 9 | | | | CB 5 phr | 3.2 |

PAI Polyamideimide
PEO Polyethylene oxide
PVDF-HPF Polyvinylidene fluoride-hexafluoropropylene copolymer
DMF Dimethylformamide
IPA Isopropyl alcohol
KFBS Potassium nonafluorobutanesulfonate
CB Carbon black

Example 31

An electroconductive member 31 was produced and evaluated in the same manner as in Example 1 except for the following: An electroconductive roller B31 was obtained without adding the roughening particles (the crosslinking acrylic particles, GR300W) serving as the rigid structural bodies to the CB dispersed urethane mixed solution used for forming the electroconductive resin layer, and with the roughening particles spread on a plane, the electroconductive roller B31 was pressed against the roughening particles and was rotated, so as to introduce the rigid structural bodies onto the outer circumferential portion of the electroconductive roller B31. The evaluation results are shown in Table 14.

Example 32

An electroconductive member 32 was produced and evaluated in the same manner as in Example 1 except for the following: An electroconductive roller B32 was obtained without adding the roughening particles (the crosslinking acrylic particles, GR300W) serving as the rigid structural bodies to the CB dispersed urethane mixed solution used for forming the electroconductive resin layer. Subsequently, a layer of polypropylene fiber having an average fiber diameter of bottom 10% fiber diameters of 80 μm was formed, as the rigid structural bodies, on the outer circumference of the electroconductive roller B32 by the melt-blow spinning method. The evaluation results are shown in Table 14. It is noted that this polypropylene fiber is thicker than the fiber forming the surface layer.

Example 33

An electroconductive member 33 was produced and evaluated in the same manner as in Example 1 except for the following: The coating material solution used for forming the surface layer having the network structure containing fibers was changed to the coating liquid shown in Table 9, the crosslinking acrylic particles (trade name: GR300W, manufactured by Negami Chemical Industrial Co., Ltd.) were not used, and the conditions for forming the network structure containing fibers were changed, so as to form the network structure and the bead structure simultaneously. The evaluation results are shown in Table 14.

Example 34

An electroconductive member 34 was produced and evaluated in the same manner as in Example 1 except that electroconductive elastic roller 34A not including an electroconductive resin layer was used as the electroconductive support layer and that irregularities were formed on the outer circumferential portion of the electroconductive elastic roller 34A by sand blasting. The evaluation results are shown in Table 14.

Example 35

An electroconductive member 35 was produced and evaluated in the same manner as in Example 34 except that materials shown in Table 5 were used as the materials of an unvulcanized rubber used for forming an electroconductive elastic roller 35A. The evaluation results are shown in Table 14.

TABLE 5

| Material | Content (parts by mass) |
|---|---|
| Epichlorohydrin-ethylene oxide-allyl glycidyl ether terpolymer (GECO) (trade name: Epichlomer CG-102, manufactured by Daiso Co., Ltd.) | 100 |
| Zinc oxide (zinc oxide type 2 manufactured by Seido Chemical Industry Co., Ltd.) | 5 |
| Calcium carbonate (trade name: Silver W manufactured by Shiraishi Calcium Kaisha, Ltd.) | 35 |
| Carbon black (trade name: SEAST SO manufactured by Tokai Carbon Co., Ltd.) | 0.5 |
| Stearic acid | 2 |
| Adipate (trade name: Polycizer W305ELS manufactured by DIC Corporation) | 10 |
| Sulfur | 0.5 |
| Dipentamethylenethiuram tetrasulfide (trade name: Nocceler TRA manufactured by Ouchi Shinko Chemical Industry Co., Ltd.) | 2 |
| Cetyltrimethylammonium bromide | 2 |

Example 36

An electroconductive member 36 was produced and evaluated in the same manner as in Example 1 except that an electroconductive resin layer directly applied on a mandrel was used as the electroconductive support layer, and that the conditions for forming the surface layer and the average particle size and the amount of the roughening particles used were changed as shown in Table 9. The evaluation results are shown in Table 14.

Example 37

An electroconductive member 37 was produced and evaluated in the same manner as in Example 1 except that an electroconductive support layer composed only of a mandrel was used as the electroconductive support layer, that the conditions for forming the surface layer were changed as shown in Table 9, and that irregularities were formed on the surface of the mandrel by sand blasting. The evaluation results are shown in Table 14.

Example 38

The coating material for forming the electroconductive resin layer used in Example 1 was dip-coated on an aluminum sheet with a thickness of 200 μm under the same conditions as in Example 1, and the coating material was cured to produce a blade-shaped electroconductive support layer in which an electroconductive resin layer containing roughening particles was formed on the aluminum sheet. Next, a surface layer having the network structure containing fibers was provided on the electroconductive support layer in the same manner as in Example 1 except that the blade-shaped electroconductive support layer was placed in a collector portion in FIG. 4 and that the electroconductive support layer was not rotated. A charging blade 38 was thus produced.

This charging blade was attached to an electrophotographic laser printer, modified for attaining a high speed as in Example 1, and disposed in contact with the photosensitive drum in the forward direction to the rotating direction of the photosensitive drum. Further, an angle θ formed between the contact point and the charging blade in the abutting point of the charging blade to the photosensitive drum was set to 20° from the viewpoint of chargeability, and a contact pressure of the charging blade against the photosensitive drum was initially set to 20 g/cm (linear pressure). The image evaluation was made under the same conditions as those employed for the charging roller. The evaluation results are shown in Table 14.

Example 39

In this example, the surface layer having the network structure containing fibers was formed by the melt-blow method. First, in the same manner as in Example 1, the coating material having roughening particles dispersed therein was applied onto an electroconductive elastic layer and cured thereon to obtain an electroconductive roller B39, which was used as an electroconductive support layer. A polypropylene resin (PP) was prepared as a thermoplastic resin, and polypropylene fiber was deposited on the electroconductive support layer by using a melt-blow apparatus to form a surface layer. The production conditions were as follows: a gear pump rotation speed of 30 rpm, a temperature of 280° C., and an air blowing rate of 0.5 $Nm^3$/min. The distance between a melt-blowing nozzle and the electroconductive support layer was set to 200 mm. Thus, an electroconductive member 39 was produced and evaluated in the same manner as in Example 1 except that the material and the production method for the surface layer were changed as described above. The evaluation results are shown in Table 14.

Comparative Examples 1 to 3

Electroconductive members C1 to C3 were produced and evaluated in the same manner as in Example 1 except that the production conditions for the surface layer were changed to those shown in Table 10. The evaluation results are shown in Table 15. In Comparative Example 2, top 10% fiber diameters for the surface layer were so large that the pattern of the fiber was output in an image, and consequently, the evaluation of an image having a blank spot or an image having a horizontal streak could not be made.

Comparative Example 4

An electroconductive member C4 was produced and evaluated in the same manner as in Example 1 except that the production conditions for the surface layer were changed to those shown in Table 10 and that the rigid structural bodies were not formed. The evaluation results are shown in Table 15.

Comparative Example 5

An electroconductive member C5 was produced and evaluated in the same manner as in Example 1 except that the average particle size of the roughening particles was changed to that shown in Table 10. The evaluation results are shown in Table 15. In this comparative example, the height of the rigid structural bodies was so large that a charging failure was caused, and consequently, the evaluation of an image having a blank spot or an image having a horizontal streak could not be made.

Comparative Example 6

An electroconductive member C6 was produced and evaluated in the same manner as in Example 1 except that a commercially available metal wire (a copper wire having a diameter of 10 μm, manufactured by Elektrisola) was used as the surface layer. The evaluation results are shown in Table 15.

TABLE 6

| | | | Example 1 | Example 2 | Example 3 | Example 4 | Example 5 | Example 6 |
|---|---|---|---|---|---|---|---|---|
| Electro-conductive support layer | Mandrel | Shape | Round bar | Round bar | Round bar | Round bar | Round bar | Round bar |
| | | Material | SUS | SUS | SUS | SUS | SUS | SUS |
| | Elastic layer | Electroconductive elastic layer | NBR | NBR | NBR | NBR | NBR | NBR |
| | | Electroconductive resin layer | CB dispersed urethane | CB dispersed urethane | CB dispersed urethane | CB dispersed urethane | CB dispersed urethane | CB dispersed urethane |
| Surface layer | | Coating material solution | Coating liquid 1 | Coating liquid 1 | Coating liquid 1 | Coating liquid 1 | Coating liquid 2 | Coating liquid 3 |
| | | Coating viscosity (cPs) | 1000 | 1000 | 1000 | 1000 | 500 | 1500 |
| | | Processing time (sec) | 90 | 90 | 90 | 90 | 900 | 30 |
| | | Rotation speed (rpm) | 1000 | 1000 | 1000 | 1000 | 1000 | 1000 |
| | | Applied voltage (kV) | 25 | 25 | 25 | 25 | 30 | 20 |
| | | Ejecting speed (ml/h) | 1 | 1 | 1 | 1 | 0.05 | 2 |

TABLE 6-continued

| | | | | | | | |
|---|---|---|---|---|---|---|---|
| Rigid structural bodies | Material | Roughening particle | Roughening particle | Roughening particle | Roughening particle | Roughening particle | Roughening particle |
| | Use amount (g) | 19.2 | 19.2 | 19.2 | 2.4 | 19.2 | 19.2 |
| | Average particle size (μm) | 19 | 3 | 190 | 18 | 19 | 18 |

| | | | | Example 7 | Example 8 | Example 9 | Example 10 |
|---|---|---|---|---|---|---|---|
| Electro-conductive support layer | Mandrel | Shape | | Round bar | Round bar | Round bar | Round bar |
| | | Material | | SUS | SUS | SUS | SUS |
| | Elastic layer | Electroconductive elastic layer | | NBR | NBR | NBR | NBR |
| | | Electroconductive resin layer | | CB dispersed urethane | CB dispersed urethane | CB dispersed urethane | CB dispersed urethane |
| Surface layer | | Coating material solution | | Coating liquid 4 | Coating liquid 1 | Coating liquid 1 | Coating liquid 2 |
| | | Coating viscosity (cPs) | | 2000 | 1000 | 1000 | 500 |
| | | Processing time (sec) | | 20 | 20 | 20 | 200 |
| | | Rotation speed (rpm) | | 1000 | 1000 | 1000 | 1000 |
| | | Applied voltage (kV) | | 15 | 25 | 25 | 30 |
| | | Ejecting speed (ml/h) | | 10 | 1 | 1 | 0.05 |
| Rigid structural bodies | | Material | | Roughening particle | Roughening particle | Roughening particle | Roughening particle |
| | | Use amount (g) | | 19.2 | 19.2 | 19.2 | 19.2 |
| | | Average particle size (μm) | | 19 | 10 | 76 | 10 |

CB: Carbon black,
Roughening particle: Crosslinking acrylic particle

TABLE 7

| | | | Example 11 | Example 12 | Example 13 | Example 14 | Example 15 | Example 16 |
|---|---|---|---|---|---|---|---|---|
| Electro-conductive support layer | Mandrel | Shape | Round bar | Round bar | Round bar | Round bar | Round bar | Round bar |
| | | Material | SUS | SUS | SUS | SUS | SUS | SUS |
| | Elastic layer | Electroconductive elastic layer | NBR | NBR | NBR | NBR | NBR | NBR |
| | | Electroconductive resin layer | CB dispersed urethane | CB dispersed urethane | CB dispersed urethane | CB dispersed urethane | CB dispersed urethane | CB dispersed urethane |
| Surface layer | | Coating material solution | Coating liquid 4 | Coating liquid 1 | Coating liquid 1 | Coating liquid 1 | Coating liquid 2 | Coating liquid 4 |
| | | Coating viscosity (cPs) | 2000 | 1000 | 1000 | 1000 | 500 | 2000 |
| | | Processing time (sec) | 15 | 30 | 30 | 30 | 300 | 15 |
| | | Rotation speed (rpm) | 1000 | 1000 | 1000 | 1000 | 1000 | 1000 |
| | | Applied voltage (kV) | 15 | 25 | 25 | 25 | 30 | 15 |
| | | Ejecting speed (ml/h) | 10 | 1 | 1 | 1 | 0.05 | 10 |
| Rigid structural bodies | | Material | Roughening particle | Roughening particle | Roughening particle | Roughening particle | Roughening particle | Roughening particle |
| | | Use amount (g) | 40 | 40 | 40 | 5 | 40 | 40 |
| | | Average particle size (μm) | 10 | 10 | 190 | 11 | 10 | 10 |

| | | | | Example 17 | Example 18 | Example 19 | Example 20 |
|---|---|---|---|---|---|---|---|
| Electro-conductive support layer | Mandrel | Shape | | Round bar | Round bar | Round bar | Round bar |
| | | Material | | SUS | SUS | SUS | SUS |
| | Elastic layer | Electroconductive elastic layer | | NBR | NBR | NBR | NBR |
| | | Electroconductive resin layer | | CB dispersed urethane | CB dispersed urethane | CB dispersed urethane | CB dispersed urethane |
| Surface layer | | Coating material solution | | Coating liquid 1 | Coating liquid 1 | Coating liquid 1 | Coating liquid 2 |
| | | Coating viscosity (cPs) | | 1000 | 1000 | 1000 | 500 |

TABLE 7-continued

| | | | | | | |
|---|---|---|---|---|---|---|
| | | Processing time (sec) | 300 | 300 | 300 | 1500 |
| | | Rotation speed (rpm) | 1000 | 1000 | 1000 | 1000 |
| | | Applied voltage (kV) | 25 | 25 | 25 | 30 |
| | | Ejecting speed (ml/h) | 1 | 1 | 1 | 0.05 |
| | Rigid structural bodies | Material | Roughening particle | Roughening particle | Roughening particle | Roughening particle |
| | | Use amount (g) | 40 | 40 | 5 | 40 |
| | | Average particle size (μm) | 10 | 204 | 10 | 11 |

TABLE 8

| | | | Example 21 | Example 22 | Example 23 | Example 24 | Example 25 | Example 26 |
|---|---|---|---|---|---|---|---|---|
| Electro-conductive support layer | Mandrel | Shape | Round bar | Round bar | Round bar | Round bar | Round bar | Round bar |
| | | Material | SUS | SUS | SUS | SUS | SUS | SUS |
| | Elastic layer | Electroconductive elastic layer | NBR | NBR | NBR | NBR | NBR | NBR |
| | | Electroconductive resin layer | CB dispersed urethane | CB dispersed urethane | CB dispersed urethane | CB dispersed urethane | CB dispersed urethane | CB dispersed urethane |
| Surface layer | | Coating material solution | Coating liquid 4 | Coating liquid 1 | Coating liquid 1 | Coating liquid 2 | Coating liquid 4 | Coating liquid 5 |
| | | Coating viscosity (cPs) | 2000 | 1000 | 1000 | 500 | 2000 | 1000 |
| | | Processing time (sec) | 30 | 350 | 350 | 800 | 35 | 180 |
| | | Rotation speed (rpm) | 1000 | 1000 | 1000 | 1000 | 1000 | 1000 |
| | | Applied voltage (kV) | 15 | 25 | 25 | 30 | 15 | 27 |
| | | Ejecting speed (ml/h) | 10 | 1 | 1 | 0.05 | 10 | 0.5 |
| Rigid structural bodies | | Material | Roughening particle | Roughening particle | Roughening particle | Roughening particle | Roughening particle | Roughening particle |
| | | Use amount (g) | 40 | 40 | 40 | 40 | 40 | 40 |
| | | Average particle size (μm) | 11 | 10 | 102 | 10 | 10 | 20 |

| | | | Example 27 | Example 28 | Example 29 | Example 30 |
|---|---|---|---|---|---|---|
| Electro-conductive support layer | Mandrel | Shape | Round bar | Round bar | Round bar | Round bar |
| | | Material | SUS | SUS | SUS | SUS |
| | Elastic layer | Electroconductive elastic layer | NBR | NBR | NBR | NBR |
| | | Electroconductive resin layer | CB dispersed urethane | CB dispersed urethane | CB dispersed urethane | CB dispersed urethane |
| Surface layer | | Coating material solution | Coating liquid 6 | Coating liquid 7 | Coating liquid 8 | Coating liquid 9 |
| | | Coating viscosity (cPs) | 1000 | 1000 | 1000 | 1000 |
| | | Processing time (sec) | 180 | 180 | 180 | 180 |
| | | Rotation speed (rpm) | 1000 | 1000 | 1000 | 1000 |
| | | Applied voltage (kV) | 23 | 22 | 25 | 25 |
| | | Ejecting speed (ml/h) | 2 | 0.2 | 1 | 1 |
| Rigid structural bodies | | Material | Roughening particle | Roughening particle | Roughening particle | Roughening particle |
| | | Use amount (g) | 40 | 40 | 40 | 40 |
| | | Average particle size (μm) | 19 | 20 | 19 | 19 |

TABLE 9

| | | | Example 31 | Example 32 | Example 33 | Example 34 | Example 35 |
|---|---|---|---|---|---|---|---|
| Electro-conductive | Mandrel | Shape | Round bar | Round bar | Round bar | Round bar | Round bar |
| | | Material | SUS | | SUS | SUS | SUS |

TABLE 9-continued

| | | | | | | | |
|---|---|---|---|---|---|---|---|
| support layer | Elastic layer | Electroconductive elastic layer | NBR | NBR | NBR | NBR | Epichloro-hydrin |
| | | Electroconductive resin layer | CB dispersed urethane | CB dispersed urethane | CB dispersed urethane | — | — |
| Surface layer | | Coating material solution | Coating liquid 1 | Coating liquid 1 | Coating liquid 1 | Coating liquid 1 | Coating liquid 1 |
| | | Coating viscosity (cPs) | 1000 | 1000 | 1000 | 1000 | 1000 |
| | | Processing time (sec) | 180 | 180 | 180 | 180 | 180 |
| | | Rotation speed (rpm) | 1000 | 1000 | 1000 | 1000 | 1000 |
| | | Applied voltage (kV) | 25 | 25 | 18 | 25 | 25 |
| | | Ejecting speed (ml/h) | 1 | 1 | 5 | 1 | 1 |
| Rigid structural bodies | | Material | Powder applied | Thick fiber | Bead | Roughened by polishing | Roughened by polishing |
| | | Use amount (g) | — | — | — | — | — |
| | | Average particle size (μm) | 19 | 104 * | 50 | — | — |

| | | | | Example 36 | Example 37 | Example 38 | Example 39 |
|---|---|---|---|---|---|---|---|
| Electro-conductive support layer | Mandrel | Shape | | Round bar | Round bar | Plate | Round bar |
| | | Material | | SUS | SUS | SUS | SUS |
| | Elastic layer | Electroconductive elastic layer | | — | — | — | NBR |
| | | Electroconductive resin layer | | CB dispersed urethane | — | CB dispersed urethane | — |
| Surface layer | | Coating material solution | | Coating liquid 1 | Coating liquid 1 | Coating liquid 1 | Melt-blow method |
| | | Coating viscosity (cPs) | | 1000 | 1000 | 1000 | |
| | | Processing time (sec) | | 180 | 180 | 180 | |
| | | Rotation speed (rpm) | | 1000 | 1000 | — | |
| | | Applied voltage (kV) | | 25 | 25 | 25 | |
| | | Ejecting speed (ml/h) | | 1 | 1 | 1 | |
| Rigid structural bodies | | Material | | Roughening particle | Roughened by polishing | Roughening particle | Roughening particle |
| | | Use amount (g) | | 40 | — | 40 | 40 |
| | | Average particle size (μm) | | 19 | — | 20 | 19 |

* Fiber diameter

TABLE 10

| | | | Comparative Example 1 | Comparative Example 2 | Comparative Example 3 | Comparative Example 4 | Comparative Example 5 | Comparative Example 6 |
|---|---|---|---|---|---|---|---|---|
| Electro-conductive support layer | Mandrel | Shape | Round bar | Round bar | Round bar | Round bar | Round bar | Round bar |
| | | Material | SUS | SUS | SUS | SUS | SUS | SUS |
| | Elastic layer | Electroconductive elastic layer | NBR | NBR | NBR | NBR | NBR | NBR |
| | | Electroconductive resin layer | CB dispersed urethane | CB dispersed urethane | CB dispersed urethane | CB dispersed urethane | CB dispersed urethane | CB dispersed urethane |
| Surface layer | | Coating material solution | PAI | PAI | PAI | PAI | PAI | Metal wire |
| | | Coating viscosity (cPs) | 300 | 3000 | 1000 | 1000 | 1000 | |
| | | Processing time (sec) | 2000 | 20 | 10 | 180 | 90 | |
| | | Rotation speed (rpm) | 1000 | 1000 | 1000 | 1000 | 1000 | |
| | | Applied voltage (kV) | 25 | 25 | 25 | 25 | 25 | |
| | | Ejecting speed (ml/h) | 0.1 | 1 | 1 | 1 | 1 | |

TABLE 10-continued

| | | Comparative Example 1 | Comparative Example 2 | Comparative Example 3 | Comparative Example 4 | Comparative Example 5 | Comparative Example 6 |
|---|---|---|---|---|---|---|---|
| Rigid structural bodies | Material | Roughening particle | Roughening particle | Roughening particle | — | Roughening particle | Roughening particle |
| | Use amount (g) | 19.2 | 19.2 | 19.2 | — | 19.2 | 19.2 |
| | Average particle size (μm) | 19 | 19 | 19 | — | 2011 | 19 |

TABLE 11

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Surface layer | Volume resistivity (Ω · cm) | 1.00E+15 | 1.00E+15 | 1.00E+15 | 1.00E+15 | 1.00E+15 | 1.00E+15 | 1.00E+15 | 1.00E+15 | 1.00E+15 | 1.00E+15 |
| | Average thickness (μm) | 50.2 | 55.8 | 59.1 | 52.6 | 51.1 | 57.7 | 58.3 | 3.9 | 3.9 | 6.4 |
| | Network density | A | A | A | A | A | B | B | C | C | B |
| | Average fiber diameter (μm) | 0.97 | 0.96 | 0.89 | 0.95 | 0.18 | 6.54 | 11.20 | 0.98 | 0.91 | 0.16 |
| | $d^{U10}$ (μm) | 1.2 | 1.1 | 1.2 | 1.1 | 0.3 | 10.8 | 14.9 | 1.0 | 1.2 | 0.2 |
| | Average value of area ratios k (—) | 59.9 | 59.2 | 59.0 | 57.5 | 118.0 | 39.5 | 26.2 | 29.3 | 27.4 | 25.3 |
| | $k^{U10}$(—) | 78 | 87 | 86 | 84 | 147 | 56 | 42 | 46 | 43 | 44 |
| Rigid structural bodies | hr/ts(—) | $1.8 \times 10^{-1}$ | $3.0 \times 10^{-2}$ | 1.6 | $1.7 \times 10^{-1}$ | $1.9 \times 10^{-1}$ | $1.6 \times 10^{-1}$ | $1.6 \times 10^{-1}$ | 1.3 | 9.6 | $7.9 \times 10^{-1}$ |
| | Average height $h_r$ (μm) | 9.3 | 1.5 | 95 | 9.0 | 9.7 | 9.2 | 9.5 | 5.1 | 38.0 | 5.1 |
| | Average density | B | A | C | C | B | B | B | A | C | A |
| | Average particle size (μm) | 19 | 3 | 190 | 18 | 19 | 18 | 19 | 10 | 76 | 10 |
| Evaluation results | Blank spot at initial stage | A | A | C | A | A | B | B | B | C | B |
| | Ratio of change in surface layer thickness before and after endurance (%) | 92 | 50 | 100 | 54 | 88 | 92 | 93 | 100 | 100 | 95 |
| | Surface layer thickness obtained after endurance (μm) | 46 | 28 | 59 | 28 | 45 | 53 | 54 | 4 | 4 | 6 |
| | Blank spot evaluated after endurance | A | B | C | B | A | B | C | B | C | B |
| | Horizontal streak evaluated after endurance | A | B | B | B | B | A | A | B | C | B |

$d^{U10}$: Arithmetic mean value of top 10% fiber diameters, Area ratio k = Area of each Voronoi polygon/cross-sectional area of fiber as each generating point
$k^{U10}$: Arithmetic mean value of top 10% area ratios k, $h_r/t_s$ = Average height of rigid structural bodies/average thickness of surface layer

TABLE 12

| | | Example 11 | Example 12 | Example 13 | Example 14 | Example 15 | Example 16 | Example 17 | Example 18 | Example 19 | Example 20 |
|---|---|---|---|---|---|---|---|---|---|---|---|
| Surface layer | Volume resistivity (Ω · cm) | 1.00E+15 | 1.00E+15 | 1.00E+15 | 1.00E+15 | 1.00E+15 | 1.00E+15 | 1.00E+15 | 1.00E+15 | 1.00E+15 | 1.00E+15 |
| | Average thickness (μm) | 7.0 | 11.8 | 10.5 | 12.4 | 11.8 | 12.4 | 399 | 398 | 391 | 397 |
| | Network density | C | C | C | C | A | C | A | A | A | A |

TABLE 12-continued

| | | Example 11 | Example 12 | Example 13 | Example 14 | Example 15 | Example 16 | Example 17 | Example 18 | Example 19 | Example 20 |
|---|---|---|---|---|---|---|---|---|---|---|---|
| | Average fiber diameter (μm) | 11.60 | 0.94 | 0.88 | 0.80 | 0.18 | 10.80 | 0.92 | 0.90 | 0.94 | 0.14 |
| | $d^{U10}$ (μm) | 14.8 | 1.2 | 1.1 | 1.1 | 0.3 | 15.0 | 1.0 | 1.0 | 1.0 | 0.3 |
| | Average value of area ratios k (—) | 22.6 | 35.6 | 32.2 | 35.4 | 65.5 | 32.1 | 64.8 | 55.2 | 61.4 | 111.2 |
| | $k^{U10}$(—) | 40 | 63 | 55 | 67 | 100 | 45 | 86 | 75 | 92 | 148 |
| Rigid structural bodies | hr/ts(—) | $7.1 \times 10^{-1}$ | $4.3 \times 10^{-1}$ | 9.1 | $4.3 \times 10^{-1}$ | $4.4 \times 10^{-1}$ | $4.1 \times 10^{-1}$ | $1.0 \times 10^{-2}$ | $2.6 \times 10^{-1}$ | $1.0 \times 10^{-2}$ | $1.0 \times 10^{-2}$ |
| | Average height $h_r$ (μm) | 5.0 | 5.1 | 95 | 5.3 | 5.2 | 5.1 | 5.2 | 102 | 5.1 | 5.3 |
| | Average density | A | A | C | C | A | A | A | C | C | A |
| | Average particle size (μm) | 10 | 10 | 190 | 11 | 10 | 10 | 10 | 204 | 10 | 11 |
| Evaluation results | Blank spot at initial stage | C | A | C | A | A | B | A | C | A | A |
| | Ratio of change in surface layer thickness before and after endurance (%) | 92 | 94 | 100 | 44 | 85 | 86 | 78 | 85 | 65 | 75 |
| | Surface layer thickness obtained after endurance (μm) | 6 | 11 | 11 | 5 | 10 | 11 | 311 | 338 | 254 | 298 |
| | Blank spot evaluated after endurance | C | A | C | B | A | C | A | C | B | A |
| | Horizontal streak evaluated after endurance | B | A | C | C | B | B | A | B | B | B |

TABLE 13

| | | Example 21 | Example 22 | Example 23 | Example 24 | Example 25 | Example 26 | Example 27 | Example 28 | Example 29 | Example 30 |
|---|---|---|---|---|---|---|---|---|---|---|---|
| Surface layer | Volume resistivity (Ω · cm) | 1.00E+15 | 1.00E+15 | 1.00E+15 | 1.00E+15 | 1.00E+15 | 1.00E+16 | 1.00E+08 | 1.00E+05 | 1.00E+05 | 1.00E+04 |
| | Average thickness (μm) | 395 | 492 | 502 | 492 | 499 | 94 | 110 | 94 | 105 | 103 |
| | Network density | B | A | A | A | A | A | A | A | A | A |
| | Average fiber diameter (μm) | 10 | 1.00 | 0.83 | 0.16 | 10.80 | 0.96 | 0.77 | 0.93 | 0.86 | 0.90 |
| | $d^{U10}$ (μm) | 14.7 | 1.3 | 1.1 | 0.2 | 14.2 | 1.0 | 1.1 | 1.1 | 1.2 | 1.2 |
| | Average value of area ratios k (—) | 33.3 | 64.2 | 57.4 | 109.2 | 25.9 | 64.4 | 59.9 | 55.1 | 60.1 | 57.2 |
| | $k^{U10}$(—) | 65 | 88 | 80 | 142 | 60 | 91 | 75 | 80 | 76 | 77 |
| Rigid structural bodies | hr/ts(—) | $1.0 \times 10^{-2}$ | $1.0 \times 10^{-2}$ | $1.0 \times 10^{-1}$ | $1.0 \times 10^{-2}$ | $1.0 \times 10^{-2}$ | $1.1 \times 10^{-1}$ | $9.0 \times 10^{-2}$ | $1.1 \times 10^{-1}$ | $9.0 \times 10^{-2}$ | $9.0 \times 10^{-2}$ |
| | Average height $h_r$ (μm) | 5.3 | 5.0 | 51 | 5.2 | 5.0 | 9.9 | 9.3 | 10.0 | 9.6 | 9.3 |
| | Average density | A | A | C | A | A | B | B | B | B | B |
| | Average particle size (μm) | 11 | 10 | 102 | 10 | 10 | 20 | 19 | 20 | 19 | 19 |
| Evaluation results | Blank spot at initial stage | B | B | C | B | C | A | A | A | A | B |
| | Ratio of change in surface layer thickness before | 77 | 79 | 86 | 78 | 77 | 93 | 92 | 93 | 95 | 92 |

TABLE 13-continued

| | | Example 21 | Example 22 | Example 23 | Example 24 | Example 25 | Example 26 | Example 27 | Example 28 | Example 29 | Example 30 |
|---|---|---|---|---|---|---|---|---|---|---|---|
| | and after endurance (%) | | | | | | | | | | |
| | Surface layer thickness obtained after endurance (μm) | 304 | 388 | 432 | 383 | 384 | 87 | 101 | 87 | 99 | 95 |
| | Blank spot evaluated after endurance | B | B | C | B | C | A | A | A | A | B |
| | Horizontal streak evaluated after endurance | A | A | B | B | A | B | A | A | A | A |

TABLE 14

| | | Example 31 | Example 32 | Example 33 | Example 34 | Example 35 | Example 36 | Example 37 | Example 38 | Example 39 |
|---|---|---|---|---|---|---|---|---|---|---|
| Surface layer | Volume resistivity (Ω · cm) | 1.00E+15 | 1.00E+15 | 1.00E+15 | 1.00E+15 | 1.00E+15 | 1.00E+15 | 1.00E+15 | 1.00E+15 | 1.00E+14 |
| | Average thickness (μm) | 103 | 99 | 95 | 103 | 100 | 105 | 111 | 104 | 98 |
| | Network density (meshes/mm$^2$) | A | A | A | A | A | A | A | A | A |
| | Average fiber diameter (μm) | 0.86 | 0.79 | 0.97 | 0.84 | 0.96 | 0.89 | 0.75 | 0.88 | 2.58 |
| | $d^{U10}$ (μm) | 1.0 | 1.2 | 1.1 | 1.0 | 1.2 | 1.1 | 1.1 | 1.2 | 5.4 |
| | Average value of area ratios k (—) | 59.1 | 65.3 | 63.0 | 61.9 | 66.0 | 63.9 | 62.4 | 64.5 | 25.2 |
| | $k^{U10}$(—) | 74 | 85 | 81 | 85 | 98 | 87 | 87 | 88 | 41 |
| Rigid structural bodies | hr/ts(—) | $9.0 \times 10^{-2}$ | $5.0 \times 10^{-1}$ | $9.0 \times 10^{-1}$ | $5.0 \times 10^{-2}$ | $5.0 \times 10^{-2}$ | $9.0 \times 10^{-2}$ | $5.0 \times 10^{-2}$ | $9.0 \times 10^{-2}$ | $9.0 \times 10^{-2}$ |
| | Average height $h_r$ (μm) | 9.7 | 52 | 85 | 5.1 | 5.2 | 9.3 | 5.0 | 9.8 | 9.3 |
| | Average density | B | B | B | — | — | B | — | B | B |
| | Average particle size (μm) | 19 | 104 | 170 | — | — | 19 | — | 20 | 19 |
| Evaluation results | Blank spot at initial stage | A | C | C | A | A | A | C | B | C |
| | Ratio of change in surface layer thickness before and after endurance (%) | 75 | 95 | 90 | 65 | 66 | 92 | 66 | 91 | 93 |
| | Surface layer thickness obtained after endurance (μm) | 77 | 94 | 86 | 67 | 66 | 96 | 73 | 94 | 91 |
| | Blank spot evaluated after endurance | B | C | C | B | B | A | C | B | C |
| | Horizontal streak evaluated after endurance | A | A | A | B | B | A | B | A | B |

TABLE 15

| | | Comparative Example 1 | Comparative Example 2 | Comparative Example 3 | Comparative Example 4 | Comparative Example 5 | Comparative Example 6 |
|---|---|---|---|---|---|---|---|
| Surface layer | Volume resistivity (Ω · cm) | 1.00E+15 | 1.00E+15 | 1.00E+15 | 1.00E+15 | 1.00E+15 | 1.00E+15 |
| | Average thickness (μm) | 98 | 102 | 5 | 105 | 54 | 52.3 |
| | Network density | A | D | D | A | A | — |
| | Average fiber diameter (μm) | 0.11 | 15.2 | 1.02 | 0.99 | 0.98 | 50.2 |
| | $d^{U10}$ (μm) | 0.2 | 20.1 | 1.3 | 1.2 | 1.2 | 30.4 |
| | Average value of area ratios k (—) | 120.5 | 20.2 | 19.2 | 61 | 65.3 | 10.2 |
| | $k^{U10}$(—) | 178 | 31 | 26 | 85 | 89 | 20 |
| Rigid structural bodies | hr/ts(—) | $1.0 \times 10^{-1}$ | $1.0 \times 10^{-1}$ | 2.0 | — | 19.0 | $1.9 \times 10^{-1}$ |
| | Average height $h_r$ (μm) | 10.1 | 9.8 | 9.8 | 0 | 1025 | 9.8 |
| | Average density | b | B | B | — | D | B |
| | Average particle size (μm) | 20.2 | 19 | 19 | — | 2011 | 19 |
| Evaluation results | Blank spot at initial stage | D | — | D | A | — | D |
| | Ratio of change in surface layer thickness before and after endurance (%) | 75 | 78 | 75 | 18 | 100 | 100 |
| | Surface layer thickness obtained after endurance (μm) | 74 | 80 | 3.8 | 19 | 54 | 52.3 |
| | Blank spot evaluated after endurance | D | — | D | D | — | D |
| | Horizontal streak evaluated after endurance | B | — | C | D | — | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-202662, filed Sep. 27, 2013, which is hereby incorporated by reference herein in its entirety.

What is claimed is:

1. An electroconductive member for electrophotography comprising:

an electroconductive support layer; and a surface layer thereon, wherein:

the surface layer has a network structure containing fibers, the fibers having an arithmetic mean value $d^{U10}$ of top 10% fiber diameters, of 0.2 μm or more and 15.0 μm or less as measured at arbitrary 100 points in an SEM observed image of the fiber, wherein:

the electroconductive support layer has a rigid structural body, and in a cross section in a thickness direction of the electroconductive member, the rigid structural body having a height of $1.0\times10^{-2}$ to $1.0\times10^{1}$ times as large as a thickness of the surface layer, and wherein:

the surface layer satisfies the following (1) to (3):

(1) when the surface layer is observed in such a manner as to face the surface layer, one or more crossings of the fibers are observed in a square region having one side length of 1.0 mm on a surface of the surface layer;

(2) when the surface layer is observed in such a manner as to face the surface layer, at least a part of the rigid structural body is observed in a square region having one side length of 1.0 mm on the surface of the surface layer; and (3) when a Voronoi tessellation is performed with generating points, the generating points being the fibers exposed on a cross section in a thickness direction of the surface layer, wherein areas of Voronoi polygons resulting from the Voronoi tessellation is defined as $S_1$, wherein cross-sectional areas in the cross section of the fibers as the generating points of the respective Voronoi polygons is defined as $S_2$, and a ratio "$S_1/S_2$" is calculated, an arithmetic mean value $k^{U10}$ of top 10% of the ratios is 40 or more and 160 or less.

2. The electroconductive member for electrophotography according to claim 1, wherein the network structure has an average thickness of 10 μm or more and 400 μm or less.

3. The electroconductive member for electrophotography according to claim 1, wherein the rigid structural body is integrated with the electroconductive support layer and present as a part of the electroconductive support layer.

4. The electroconductive member for electrophotography according to claim 1, wherein the rigid structural body is independent of the electroconductive support layer.

5. The electroconductive member for electrophotography according to claim 1, wherein the rigid structural body is formed of fibers, and an arithmetic mean fiber diameter of the rigid structural body is larger than an arithmetic mean fiber diameter of the fibers forming the network structure.

6. The electroconductive member for electrophotography according to claim 1, wherein the rigid structural body and the fibers forming the network structure are made of the same material, and the rigid structural bodies are connected to one another through the fiber.

7. The electroconductive member for electrophotography according to claim 1, wherein the fibers forming the network structure have a volume resistivity of $1.0\times10^{5}$ Ω·cm or more and $1.0\times10^{15}$ Ω·cm or less.

8. The electroconductive member for electrophotography according to claim 1, wherein the surface layer having the network structure is formed by an electrospinning method.

9. The electroconductive member for electrophotography according to claim 1, wherein the electroconductive member is a charging member.

10. A process cartridge detachably mountable to a main body of an electrophotographic apparatus, comprising the electroconductive member according to claim 1.

11. The process cartridge according to claim 10, wherein the process cartridge comprises:

an electrophotographic photosensitive member; and a charging member for charging the electrophotographic photosensitive member, and the charging member is the electroconductive member.

12. An electrophotographic apparatus comprising the electroconductive member according to claim 1.

13. The electrophotographic apparatus according to claim 12, wherein the electrophotographic apparatus comprises:

an electrophotographic photosensitive member; and a charging member for charging the electrophotographic photosensitive member, and the charging member is the electroconductive member.

* * * * *